US006230407B1

(12) United States Patent
Akutsu

(10) Patent No.: US 6,230,407 B1
(45) Date of Patent: May 15, 2001

(54) METHOD OF CHECKING WHETHER NONCONDENSABLE GASES REMAIN IN HEAT PIPE AND PROCESS FOR PRODUCING HEAT PIPE

(75) Inventor: Shoji Akutsu, Tochigi (JP)

(73) Assignee: Showa Aluminum Corporation, Osaka (JP)

( * ) Notice: Subject to any disclaimer, the term of this patent is extended or adjusted under 35 U.S.C. 154(b) by 0 days.

(21) Appl. No.: 09/345,780

(22) Filed: Jul. 1, 1999

(30) Foreign Application Priority Data

Jul. 2, 1998 (JP) ..... 10-187653
Jul. 2, 1998 (JP) ..... 10-187658
Jul. 2, 1998 (JP) ..... 10-187660

(51) Int. Cl.[7] ..... B23P 15/26
(52) U.S. Cl. ..... 29/890.032; 29/890.03
(58) Field of Search ..... 165/104.21, 104.26, 165/104.27; 29/890.032, 407.08, 890.03

(56) References Cited

U.S. PATENT DOCUMENTS 4,046,190 * 9/1977 Marcus et al. .
4,343,763 * 8/1982 McGuire .
4,799,537 * 1/1989 Hoke, Jr. .
4,917,177 * 4/1990 Gernert .
4,917,178 * 4/1990 Kosson et al. .
5,271,546 * 12/1993 Hardwick .
5,529,484 * 6/1996 Moard et al. .
5,566,751 * 10/1996 Anderson et al. .

* cited by examiner

*Primary Examiner*—I. Cuda Rosenbaum
(74) *Attorney, Agent, or Firm*—Armstrong, Westerman, Hattori, McLeland & Naughton, LLP

(57) ABSTRACT

A heat pipe is produced by forming on a container an outwardly projecting tube portion having an interior in communication with the interior of the container for providing a gas retaining portion, injecting a working liquid into the container through an outer end opening of the tube portion, subsequently closing the end opening of the tube portion to thereby form the gas retaining portion on the container, heating the container to evaporate the working liquid to cause the gas retaining portion to retain therein noncondensable gases within the container, thereafter closing a container opening in communication with the gas retaining portion and separating the gas retaining portion from the container for removal. The weight of the container having the gas retaining portion and the combined weight of the heat pipe obtained and the separated gas retaining portion are measured and compared.

19 Claims, 16 Drawing Sheets

METHOD OF CHECKING WHETHER NONCONDENSABLE GASES REMAIN IN HEAT PIPE AND PROCESS FOR PRODUCING HEAT PIPE

BACKGROUND OF THE INVENTION

The present invention relates to fabrication of heat pipes, and more particularly to a method of checking whether noncondensable gases remain in the heat pipe. The invention relates also to a process for producing heat pipes without allowing noncondensable gases to remain therein.

The heat pipe comprises a container and a condensable working liquid, such as water or PFC, enclosed in the container. If the heat pipe contains $O_2$, $CO_2$ and like noncondensable gases remaining therein, the working liquid fails to evaporate smoothly, impairing the performance of the heat pipe. Accordingly, it is required to fabricate heat pipes without permitting the noncondensable gases to remain therein to the greatest possible extent.

JP-B No. 78873/1994 discloses a process for producing such heat pipes. This process comprises providing an injection-closing nozzle at one end of a container in the form of a closed tube, evacuating the container through the nozzle, injecting a working liquid into the container through the nozzle, temporarily closing the nozzle at the outer end thereof, subsequently heating the container to evaporate the working liquid and thereby cause the nozzle to retain therein noncondensable gases within the container, thereafter completely closing the nozzle at its base end and cutting off a nozzle portion outward of the base end.

With this process, the noncondensable gases in the container are driven into the nozzle by heating and retained therein, whereas noncondensable gases are likely to remain in the heat pipe obtained since it is impossible to check whether the noncondensable gases in the container are completely retained in the nozzle.

Further because a major portion of the nozzle is removed, the process requires correspondingly increased material and working costs.

The process described is applicable also to the fabrication of a flat platelike heat pipe which comprises a container made from a clad metal plate having a tubular bulged portion, and a working fluid enclosed in the bulged portion. The container bulged portion is then provided with a working liquid inlet which is opened at an edge of the clad metal plate and which has connected thereto, for example, a metal tube serving as the injection-closing nozzle. However, the application of the process involves a problem, for example, when an increased amount of working liquid is injected into the tubular bulged portion. The working liquid will enter the nozzle from the interior of the bulged portion when bumped by heating the container, and a large amount of working liquid will be lost when the nozzle is subsequently cut off at its base end. To prevent the working liquid from flowing out in this way when the container is heated, it appears useful to provide a constriction in the tubular bulged portion in the vicinity of the liquid outlet, whereas difficulty will then be encountered in injecting the working liquid from the inlet.

JP-A No. 170889/1997 also discloses a process for producing a heat pipe so as not to allow noncondensable gases to remain in its interior. This process comprises injecting a working liquid into a closed tubular container having an injection tube at one end thereof, then temporarily closing the injection tube at a portion thereof toward its outer end, subsequently heating the container to evaporate the working liquid and thereby cause noncondensable gases within the container to be retained in the injection tube, detecting a boundary between the noncondensable gas portion and the working liquid based on a surface temperature difference of the injection tube in the lengthwise direction thereof, completely closing the injection tube in the vicinity of the boundary, and thereafter cutting the injection tube between the completely closed portion and the temporarily closed portion.

However, the position of the boundary is liable to shift according to production conditions, and the position at which the injection tube is completely closed is altered correspondingly. The injection tube portion remaining on the container after cutting then varies in length from pipe to pipe, consequently resulting in variations in the external size of heat pipes and possibly presenting difficulty in installing the heat pipes.

Because a major portion of the injection tube is removed, the disclosed process also requires correspondingly increased material cost and working cost.

Although the process is applicable also to the fabrication of flat platelike heat pipes, the same problem as is involved in the application of the process of JP-B No. 78873/1994 to the fabrication of such heat pipes will be encountered in this case.

SUMMARY OF THE INVENTION

A first object of the present invention is to make it possible to produce a heat pipe without permitting noncondensable gases to remain therein and without entailing variations in external size that would influence its amenability to installation.

A second object of the invention is to make it possible to produce a heat pipe without permitting noncondensable gases to remain therein and without entailing an impaired yield due to the removal of an excess of material.

A third object of the invention is to provide a flat platelike heat pipe which contains no noncondensable gases remaining therein and which can be fabricated by injecting a working liquid into a container free of trouble and heating the container with the working liquid prevented from flowing out.

For use in producing a heat pipe by forming on a container an outwardly projecting tube portion having an interior in communication with the interior of the container for providing a gas retaining portion, injecting a working liquid into the container through an outer end opening of the tube portion, subsequently closing the end opening of the tube portion to thereby form the gas retaining portion on the container, heating the container to evaporate the working liquid and thereby cause the gas retaining portion to retain therein noncondensable gases within the container, thereafter closing a container opening in communication with the gas retaining portion and separating the gas retaining portion from the container for removal, the present invention provides as a first feature thereof a method of checking whether the noncondensable gases remain in the heat pipe which method comprises measuring the weight of the container having the gas retaining portion and the combined weight of the heat pipe obtained and the separated gas retaining portion for comparison, and ascertaining that the heat pipe obtained contains the noncondensable gases remaining therein as indicated by the result of comparison when no difference is found between the two weights, or ascertaining that the heat pipe obtained contains no noncondensable gases remaining therein as indicated by the result of comparison when the latter weight is smaller than the former weight.

When the working liquid is evaporated by heating the container having the gas retaining portion, the noncondensable gases within the container, i.e., the noncondensable gases, such as $N_2$, $O_2$ and $CO_2$, dissolved in the working liquid, or these gases and noncondensable gases remaining in the container, are driven into the gas retaining portion and caused to remain in this portion by the evaporated gaseous working liquid. In the case where a boundary between the portion of noncondensable gases and the gaseous working liquid is positioned within the gas retaining portion in this state, no noncondensable gases are to remain in the heat pipe which is obtained by thereafter closing the container opening in communication with the gas retaining portion and separating the gas retaining portion from the container for removal. In the vicinity of the boundary in this case, the gaseous working liquid adheres to the inner surface of the gas retaining portion upon condensation, and the adhering condensate thereafter spreads out into the atmosphere from the opening of the gas retaining portion separated from the container, with the result that the combined weight of the heat pipe obtained and the separated gas retaining portion becomes smaller than the weight of the container having the gas retaining portion. On the other hand, in the case where the boundary between the portion of noncondensable gases and the gaseous working liquid is positioned within the container, the noncondensable gases are to remain in the heat pipe obtained. The gaseous working liquid undergoing condensation in the vicinity of the boundary remains within the container in this case, so that no difference occurs between the weight of the container having the gas retaining portion and the combined weight of the heat pipe obtained and the separated gas retaining portion.

Thus, the first feature of the present invention makes it possible to readily check whether the noncondensable gases remain in the heat pipe obtained by the very simple method of measuring and comparing the weights.

In the checking method described as the first feature of the invention, the container may comprise a clad metal plate having a tubular bulged portion for enclosing the working liquid in the container, and the tubular bulged portion has an open end at an edge of the plate.

In this case, the outwardly projecting tube portion comprises a tube having one end joined to a peripheral edge of the bulged portion open end. Alternatively, the outwardly projecting tube portion comprises a tubular bulged portion outwardly projecting from the clad metal plate for providing the gas retaining portion so as to be integral with the tubular bulged portion for enclosing the working liquid.

On the other hand, the container may comprise a tube having a large diameter and closed at opposite ends with respective end caps, and the outwardly projecting tube portion comprises a tube having a small diameter and joined at one end thereof to an inner periphery defining a hole formed in one of the end caps.

The first feature of the invention further includes a process for producing a heat pipe by forming on a container an outwardly projecting tube portion having an interior in communication with the interior of the container for providing a gas retaining portion, injecting a working liquid into the container through an outer end opening of the tube portion, subsequently closing the end opening of the tube portion to thereby form the gas retaining portion on the container, heating the container to evaporate the working liquid and thereby cause the gas retaining portion to retain therein noncondensable gases within the container, thereafter closing a container opening in communication with the gas retaining portion and separating the gas retaining portion from the container for removal, the process being practiced under a production condition found by a method according to claim 1 and not permitting the noncondensable gases to remain in the heat pipe.

Stated more specifically, it is thought that the boundary between the portion of noncondensable gases and the gaseous working liquid shifts, for example, with the capacity of the gas retaining portion. Since the quantity of noncondensable gases dissolved in the working liquid increases in proportion to the amount of working liquid, it appears that the boundary shifts also with the amount of working liquid injected into the container. Accordingly the production condition not permitting the noncondensable gases to remain in the heat pipe can be found easily by preparing heat pipes by the above process on an experimental basis, for example, with the capacity of the gas retaining portion or the amount of working liquid to be injected varied suitably while holding the other production conditions constant, and by checking the heat pipes as to whether the noncondensable gases remain therein. If heat pipes are thereafter fabricated under the same production condition as is thus found, the pipes obtained contain no noncondensable gases remaining therein. Moreover, the heat pipes are each obtained finally by closing the container opening in communication with the gas retaining portion and separating the gas retaining portion from the container for removal, so that the pipes are all definite in external size and are highly amenable to installation.

The present invention provides as a second feature thereof a process for producing a heat pipe comprising preparing a container having a working liquid inlet and a gas retaining receptacle having an opening portion snugly fittable in the liquid inlet, snugly fitting the receptacle opening portion into the liquid inlet after injecting a working liquid into the container through the inlet, heating the container to evaporate the working liquid and thereby cause the receptacle to retain therein noncondensable gases within the container, thereafter closing the liquid inlet and removing the receptacle opening portion from the liquid inlet.

This process does not require the removal of an excessive material such as that of the nozzle or injection tube unlike the two processes of the prior art described first but permits repeated use of the gas retaining receptacle, hence an improved yield.

In the process described as the second feature of the invention, the container may comprise a clad metal plate having a tubular bulged portion for enclosing the working liquid in the container, the tubular bulged portion having an open end at an edge of the plate.

Alternatively, the container may comprise a tube having a large diameter and closed at opposite ends with respective end caps and a tube having a small diameter and joined at one end thereof to an inner periphery defining a hole formed in one of the end caps.

When the container is heated, the gas retaining receptacle is fixed to the container to prevent the receptacle opening portion from slipping out of the liquid inlet. Similarly, when the container is heated, the receptacle is alternatively pressed against the container to prevent the receptacle opening portion from slipping out of the liquid inlet.

The present invention provides as a third feature thereof a process for producing a flat platelike heat pipe comprising:

preparing a container made from a clad metal plate having a tubular bulged portion, the tubular bulged portion being provided with a working liquid inlet and noncondensable gas outlet each opened at an edge of the plate, the tubular bulged portion being provided with a constriction in the vicinity of the gas outlet, the container being provided with a gas retaining portion in the form of an outward projection and having an interior in communication with the interior of the tubular bulged portion through the gas outlet, closing the liquid inlet after injecting a working liquid into the tubular bulged portion of the container, heating the container to evaporate the working liquid and thereby cause the gas retaining portion to retain therein noncondensable gases within the tubular bulged portion while preventing the working liquid from flowing out owing to bumping by the constriction, and thereafter closing the gas outlet and separating the gas retaining portion from the container for removal.

This process ensures injection of the working liquid into the tubular bulged portion through the liquid inlet free of trouble, while the constriction effectively prevents the working liquid from flowing out on bumping when the container is heated.

In the process described as the third feature of the invention, the liquid inlet and the gas outlet are so positioned that the working liquid does not flow into the gas retaining portion when injected into the tubular bulged portion and that the noncondensable gases do not remain in the vicinity of the liquid inlet inside the bulged portion when evaporated by heating the container.

The gas retaining portion may comprise a tube closed at one end and joined at the other end to a peripheral edge part of the gas outlet of the tubular bulged portion. The closed end of the tube may be made hemispherical and closed.

Alternatively, the gas retaining portion may comprise a tubular bulged portion outwardly projecting from the clad metal plate so as to be integral with the tubular bulged portion for enclosing the working liquid.

Further alternatively, the gas retaining portion may comprise a gas retaining receptacle having an opening portion snugly fitted in the gas outlet.

BRIEF DESCRIPTION OF THE DRAWINGS

FIG. 1 is a perspective view showing the step of injecting a working liquid into a container;

FIG. 2 is a perspective view showing the step of measuring the weight of the container having a gas retaining portion;

FIG. 3(*a*) is a view in vertical section showing the step of heating the container, (b) is an enlarged fragmentary view in vertical section showing the step of closing a container opening in communication with the gas retaining portion by collapsing, (c) is an enlarged fragmentary view in vertical section showing the step of separating the gas retaining portion from the container for removal, and (d) is an enlarged fragmentary view in vertical section showing the step of welding a cut end of the collapsed container opening;

FIG. 4 is a perspective view showing the step of measuring the combined weight of the heat pipe obtained and the gas retaining portion separated off;

FIG. 5 shows some steps involved in producing a heat pipe with use of a gas retaining portion of relatively small capacity, (a) is a view in vertical section showing the step of heating a container, (b) is an enlarged fragmentary view, and (c) is a view in vertical section showing the heat pipe obtained and the gas retaining portion as separated off;

FIG. 6 shows some steps involved in producing a heat pipe with use of a gas retaining portion of relatively large capacity, (a) is a view in vertical section showing the step of heating a container, (b) is an enlarged fragmentary view, and (c) is a view in vertical section showing the heat pipe obtained and the gas retaining portion as separated off;

FIG. 9 is a perspective view showing the step of injecting a working liquid into a container;

FIG. 10 is a perspective view showing the step of snugly fitting an opening portion of a gas retaining receptacle into a liquid inlet of the container;

FIG. 11(*a*) is a view in vertical section showing the step of heating the container, (b) is an enlarged fragmentary view in vertical section showing the step of collapsing the lower part of the container liquid inlet portion, (c) is an enlarged fragmentary view in vertical section showing the step of removing the opening portion of the gas retaining receptacle from the liquid inlet, (d) is an enlarged fragmentary view in vertical section showing the step of collapsing the upper part of the container liquid inlet portion, and (e) is an enlarged fragmentary view in vertical section showing the step of welding the upper end of the collapsed liquid inlet portion of the container;

FIG. 12 is a perspective view showing the resulting heat pipe;

FIG. 13 is an enlarged fragmentary perspective view showing the step of fitting to a container a gas retaining receptacle equipped with a fixing device;

FIG. 14 is an enlarged fragmentary perspective view showing the gas retaining receptacle equipped with the fixing device and as fitted to the container;

FIG. 17 is a perspective view showing the step of injecting a working liquid into a container;

FIG. 18 is a perspective view showing the step of closing a liquid inlet of the container;

FIG. 19(*a*) is a view in vertical section showing the step of heating the container, (b) is an enlarged fragmentary view in vertical section showing the step of collapsing a gas outlet portion of the container, (c) is an enlarged fragmentary view in vertical section showing the step of separating off a gas retaining portion from the gas outlet portion of the container, and (d) is an enlarged fragmentary view in vertical section showing the step of welding a cut end of the gas outlet portion of the container;

FIG. 20 is a perspective view showing the resulting heat pipe;

DESCRIPTION OF THE PREFERRED EMBODIMENTS

FIGS. 1 to 6 show a first embodiment of first feature of the invention, which is an application of the invention to the fabrication of a flat platelike heat pipe for use as a heat sink, for example, in personal computers or like electronic devices.

Figure 1:
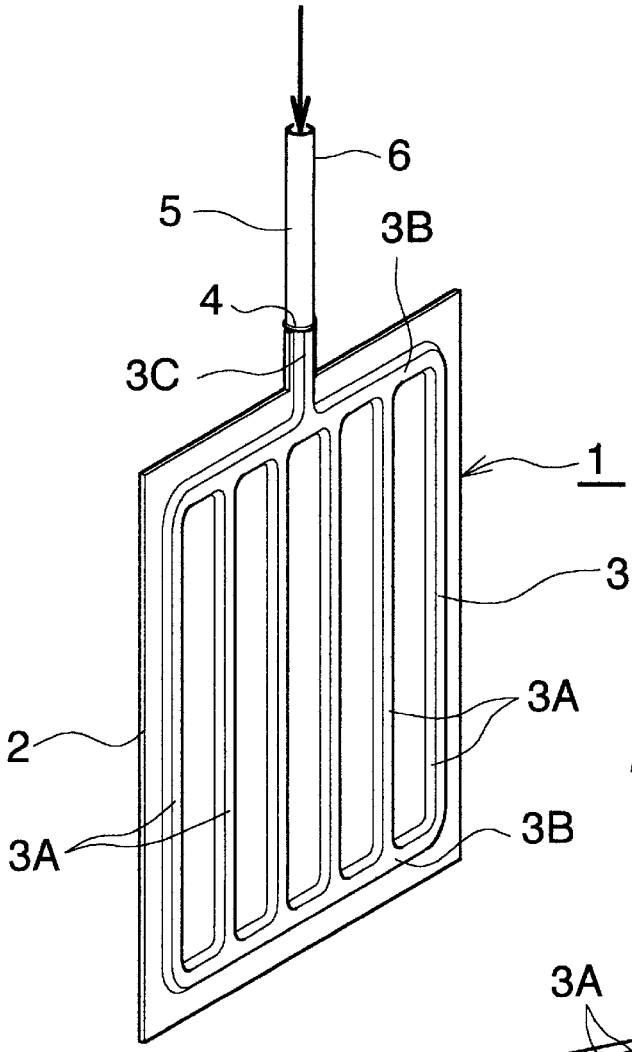
FIGS. 1 to 6 show a first embodiment of first feature of the invention.

First, a container 1 shown in FIG. 1 is prepared. This container 1 is made from a clad metal plate 2 having a tubular bulged portion 3 for enclosing a working liquid. The clad plate 2 comprises, for example, two aluminum alloy sheets. The tubular bulged portion 3 is produced by forming a nonbonded portion of predetermined pattern in the clad plate 2 and bulging the nonbonded portion toward one side or opposite sides. The tubular bulged portion 3 comprises a plurality of parallel straight parts 3A extending vertically, two communication parts 3B extending horizontally so as to cause all the straight parts 3A to communicate with one another respectively at upper and lower ends of the clad plate, and an injection part 3C extending upward from the lengthwise midportion of the upper communication part 3B. However, the pattern of the bulged portion 3 is not limited to the one shown in FIG. 1 but can be modified suitably. The clad plate 2 is cut away at opposite sides of upper half of the injection part 3C, whereby the upper half of the injection part 3C is made to project upward. The injection part 3C has an open upper end 4.

The container 1 is fabricated preferably by the so-called roll bonding process, i.e., by printing a parting agent in a predetermined pattern on at least one of the opposed surfaces of two metal sheets to be joined, then bonding the metal sheets under pressure to obtain a clad metal plate 2 having a nonbonded portion and introducing a pressure fluid into the nonbonded portion of the clad plate 2 to form a tubular bulged portion 3 in its entirety at a time, because this process has the advantages of forming the tubular bulged portion 3 of complex pattern, giving a leakage-free product, being highly amenable to mass production and having greater freedom with respect to the size and configuration of the product.

The container 1 is provided with an outwardly projecting tube portion 5 having an interior in communication with the interior of the container 1 for providing a gas retaining portion 7. According to the present embodiment, a metal tube 6 is welded at its lower end to the peripheral edge of the open upper end 4 of the tubular bulged portion 2 to form the tube portion 5.

Next as seen in FIG. 1, the working liquid is injected into the tubular bulged portion 3 of the container 1 from the outer end opening of the tube portion 5. Examples of useful working liquids are PFC, HFC134a, CFC113, HCFC123, etc.

Figure 2:
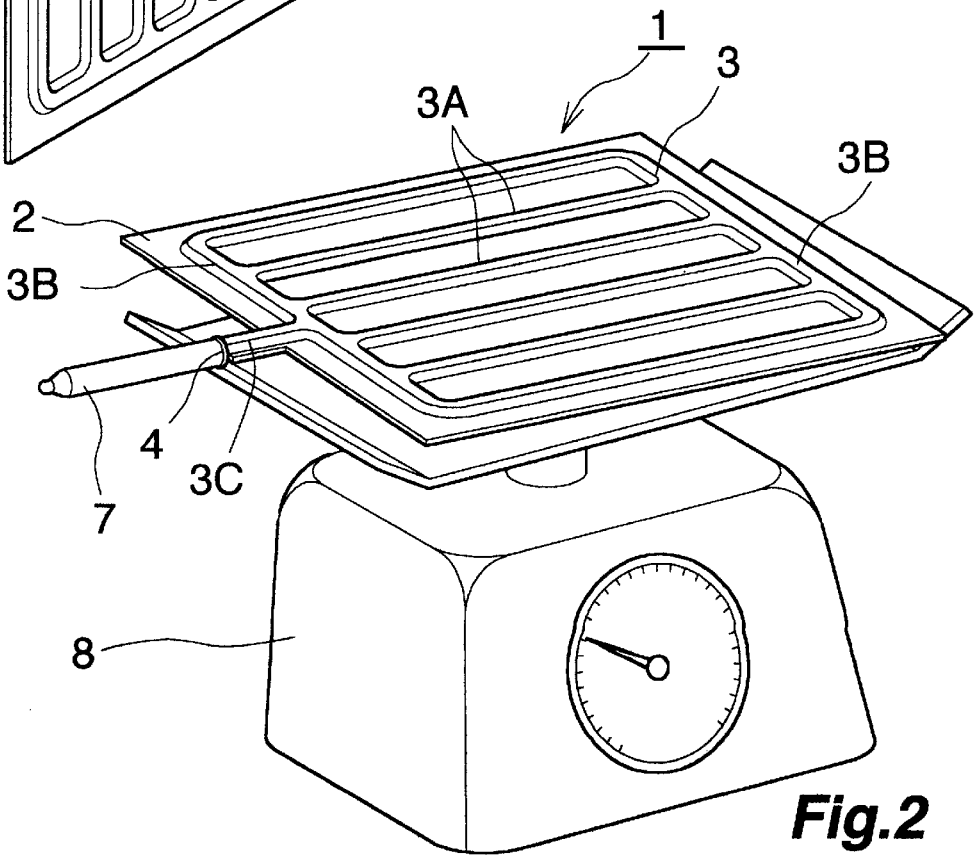

The outer end of the tube portion 5 is thereafter collapsed to close the end opening and thereby form the gas retaining portion 7 on the container 1 (see FIG. 2).

The weight of the container 1 having the gas retaining portion 7 is then measured by a weighing instrument 8.

Figure 3:
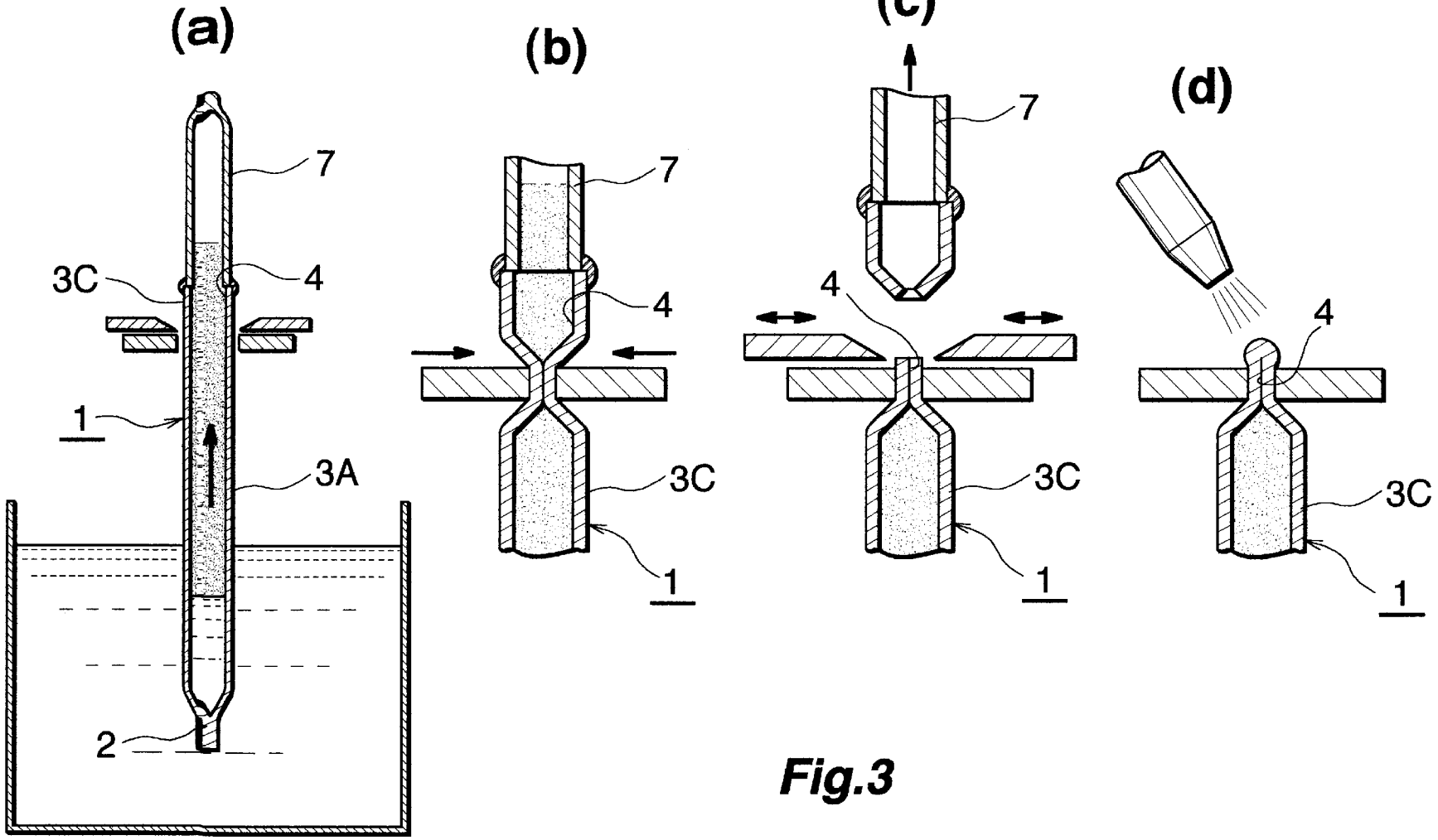

Subsequently, the container 1 is heated with the retaining portion 7 up by immersing the lower portion thereof in hot water at 60° C. for a specified period of time as shown in FIG. 3(*a*). This evaporates the working liquid within the container 1 into a gas. The the combined weight for comparison with the weight previously measured of the container 1 having the gas retaining portion 7. The result of comparison indicates that noncondensable gases remain in the heat pipe 10 obtained when there is no difference whatever between the weight of the container 1 having the gas retaining portion 7 and the combined weight of the heat pipe 10 obtained and the gas retaining portion 7 separated off, or there is a difference, for example, of less than 0.1 g and therefore substantially no difference therebetween. On the other hand, the result of comparison indicates that no noncondensable gases remain in the heat pipe 10 obtained when the latter is, for example, at least 0.3 g smaller than the former.

Next, a process will be described below for producing heat pipes containing no noncondensable gases remaining therein using the method described above.

First, several kinds of containers 1 are prepared which have metal tubes 5 different in length and serving as outwardly projecting tube portions 6. Heat pipes 10 are fabricated on an experimental basis in the same manner as described above under the same conditions with the exception of using these containers 1 in the order of increasing tube lengths. The pipes 10 are checked as noncondensable gases, such as $N_2$, $O_2$ and $CO_2$, dissolved in the working liquid and those remaining in the tubular bulged portion 3 of the container 1 are driven into the gas retaining portion 7 and caused to remain in this portion by the evaporated gaseous working liquid [see FIG. 3(*a*)].

With reference to FIG. 3(*b*), then follows is the step of collapsing the open upper end 4 of injection part 3C of the container bulged portion 3, i.e., the portion of the container opening 4 in communication with the gas retaining portion 7 to close the opening 4.

The container 1 is then cut at the upper end of collapsed portion of communication opening 4 as shown in FIG. 3(*c*) to thereby separate the gas retaining portion 7 from the container 1 for removal.

Further with reference to FIG. 3(*d*), the cut upper end of the collapsed portion of communication opening 4 is welded. In this way, a flat platelike heat pipe 10 is obtained which contains the working liquid enclosed in the tubular bulged portion 3 of the container 1 (see FIG. 4).

Figure 4:
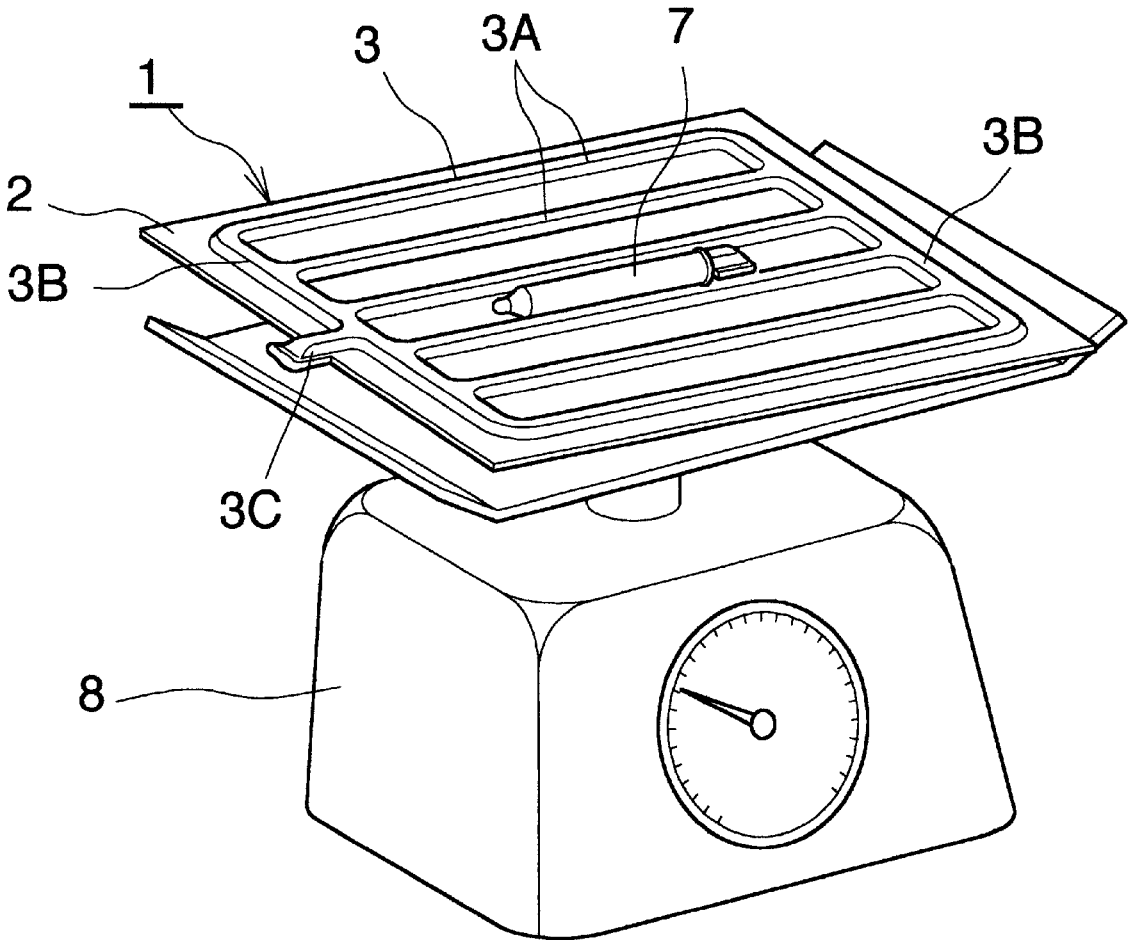

Next as seen in FIG. 4, the heat pipe 10 obtained and the gas retaining portion 7 separated off are placed on the weighing instrument 8 at the same time to measure to whether the noncondensable gases remain therein by the above method.

Figure 5:
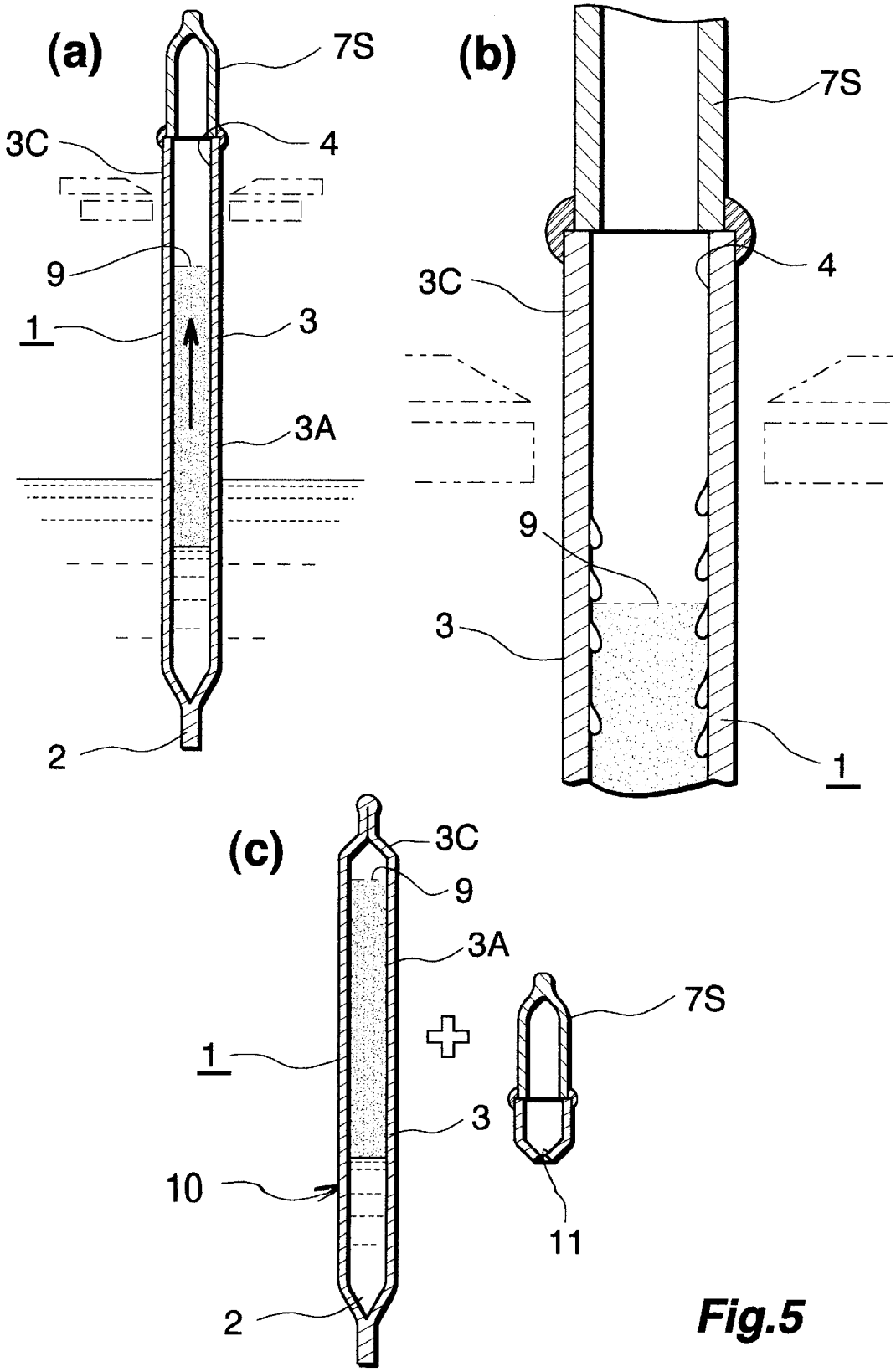

FIG. 5 shows some steps included in the process for producing a heat pipe 10 having a metal tube 5 of relatively short length and therefore a gas retaining portion 7S of relatively small capacity. In this case, there is no substantial difference between the weight of the container 1 having the gas retaining portion 7S [see FIG. 5(*a*)] and the combined weight of the heat pipe 10 and the gas retaining portion 7S separated off [see FIG. 5(*c*)]. With reference to FIG. 5(*a*) showing the interior of the container 1 having the gas retaining portion 7S and resulting from heating, the boundary 9 between the portion of noncondensable gases and the evaporated gaseous working liquid is positioned within the tubular bulged portion 3 of the container 1. In the vicinity of the boundary 9, the gaseous working liquid adheres to the inner surface of the bulged portion 3 on condensation [see FIG. 5(*b*)], and the adhering condensate remains within the container bulged portion 3 without egressing even when the container opening 4 in communication with the gas retaining portion 7S is thereafter closed, and the gas retaining portion 7S is separated from the container 1 [see FIG. 5(*c*)]. Accordingly, the production process involves no loss of the working liquid from the container 1 in this case, creating no difference between the weight of the container 1 having the gas retaining portion 7S and the combined weight of the heat pipe 10 and the gas retaining portion 7S separated off as stated above.

Figure 6:
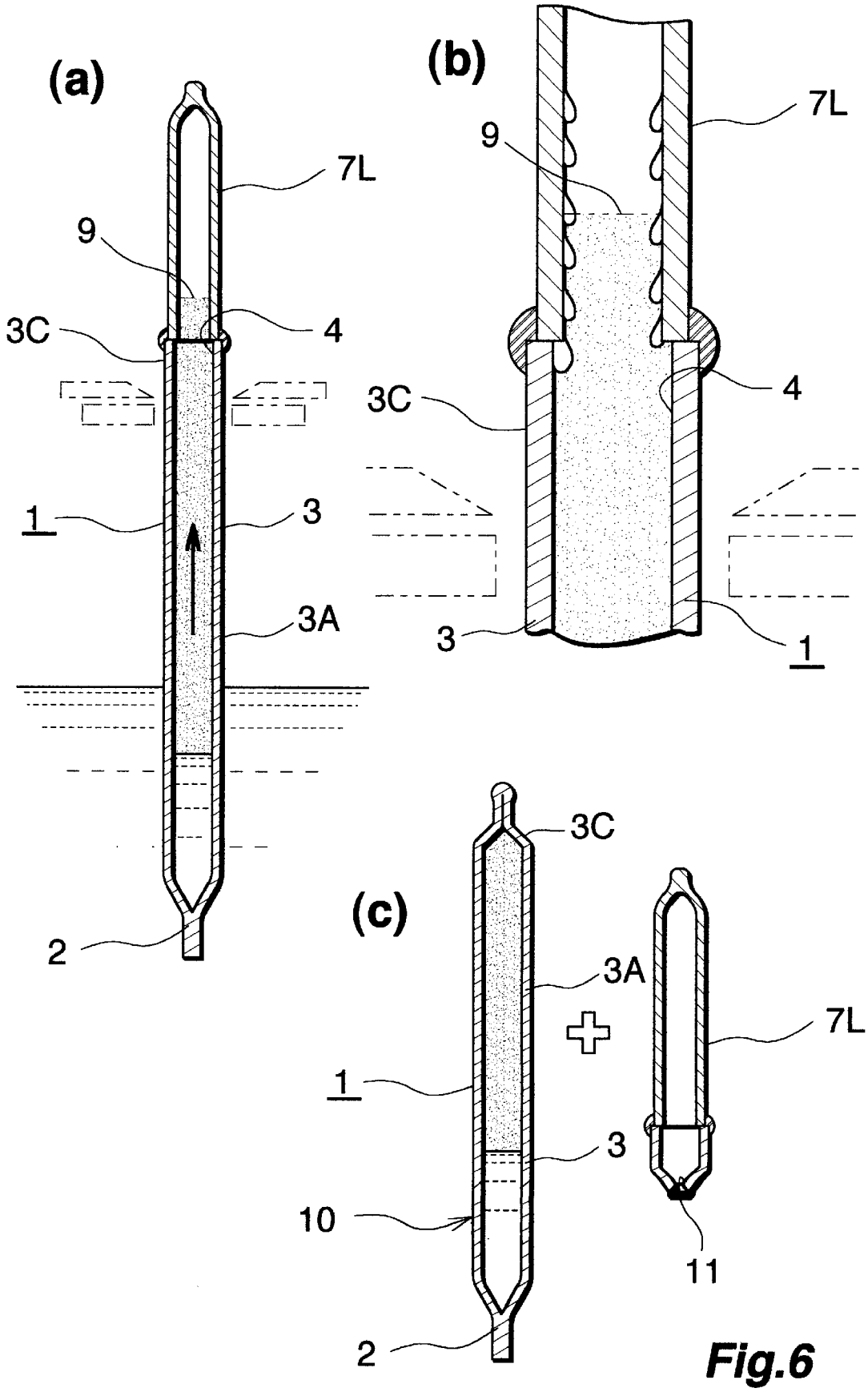

FIG. 6 shows some steps included in the process for producing a heat pipe 10 having a metal tube 5 of relatively large length and therefore a gas retaining portion 7L of relatively large capacity. In this case, a comparison between the weight of the container 1 having the gas retaining portion 7L [see FIG. 6(*a*)] and the combined weight of the heat pipe 10 and the gas retaining portion 7L separated off [see FIG. 6(*c*)] reveals that the latter is smaller than the former. With reference to FIG. 6(*a*) showing the interior of the container 1 having the gas retaining portion 7L and resulting from heating, the boundary 9 beween the portion of noncondensable gases and the evaporated gaseous working liquid is positioned within the gas retaining portion 7L. In the vicinity of the boundary 9, the gaseous working liquid adheres to the inner surface of the gas retaining portion 7L on condensation [see FIG. 6(*b*)], and the adhering condensate dissipates into the atmosphere from the opening 11 of the retaining portion 7L separated off when the container opening 4 in communication with the gas retaining portion 7L is thereafter closed, and the gas retaining portion 7L is separated from the container 1 [see FIG. 6(*c*)]. Accordingly, the production process involves a loss of the working liquid from the container 1, creating a substantial difference between the weight of the container 1 having the gas retaining portion 7L and the combined weight of the heat pipe 10 and the gas retaining portion 7L separated off as stated above.

When the experimental fabrication of the heat pipe 1 and the comparison between the weight measurements are repeated in this way, a length of metal tube 5 is found that produces a distinct difference between the weight of the container 1 having the gas retaining portion 7L and the combined weight of the heat pipe 10 and the gas retaining portion 7L separated off. When the same production conditions as involved in this case are thereafter used, heat pipes 10 can be reliably fabricated with no noncondensable gases remaining therein without measuring and comparing the weights.

The production condition under which the combined weight of the heat pipe 10 and the gas retaining portion 7 separated off becomes smaller than the weight of the container 1 having the gas retaining portion 7 can be found alternatively by producing heat pipes 10 on an experiment basis and conducting weight measurement comparison with use of stepwise increasing amounts of working liquid for the containers of the pipes. This is because the greater the amount of the working liquid, the larger is the quantity of noncondensable gases dissolved in the working liquid, and the boundary between the portion of noncondensable gases and the gaseous working liquid in the container 1 having the gas retaining portion 7 gradually shifts from inside the container bulged portion 3 toward inside the gas retaining portion 7 in corresponding relation with this tendency.

According to the embodiment described, the working liquid is injected into the tubular bulged portion 3 while allowing the noncondensable gases within this portion 3 to remain therein, and the open upper end 4 of the outwardly projecting tube portion 5 is thereafter closed, whereas the noncondensable gases remaining in the tubular bulged portion 3 may be removed through the opening 4 before the liquid injection using, for example, a vacuum pump.

Figure 7:
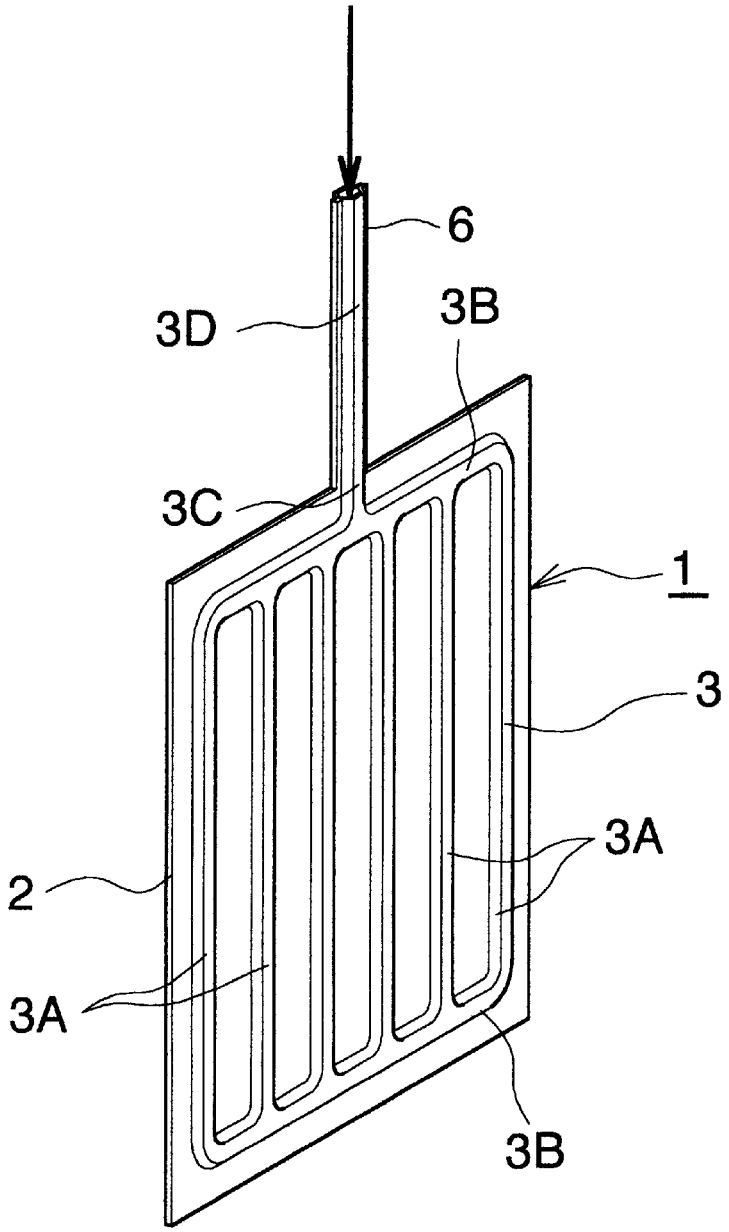
FIG. 7 is a perspective view showing a second embodiment of first feature of the invention in the step of injecting a working liquid into a container.

FIG. 7 shows a second embodiment of first feature of the invention. The second embodiment is the same as the first with the exception of the following. As shown in FIG. 7, this embodiment has an outwardly projecting tube portion 6 which is formed by part of the clad metal plate 2 providing the container 1. More specifically, the container 1 shown in FIG. 7 has a gas retaining portion forming tubular bulged part 3D extending upward from, and integral with, the injection part 3C of the tubular bulged portion 3 for enclosing the working liquid. This eliminates the use of the metal tube 5, a separate part, which is necessary for the first embodiment, so that the second embodiment is less costly and saves the time and labor required for welding the metal tube 5 to the clad plate 2.

Figure 8:
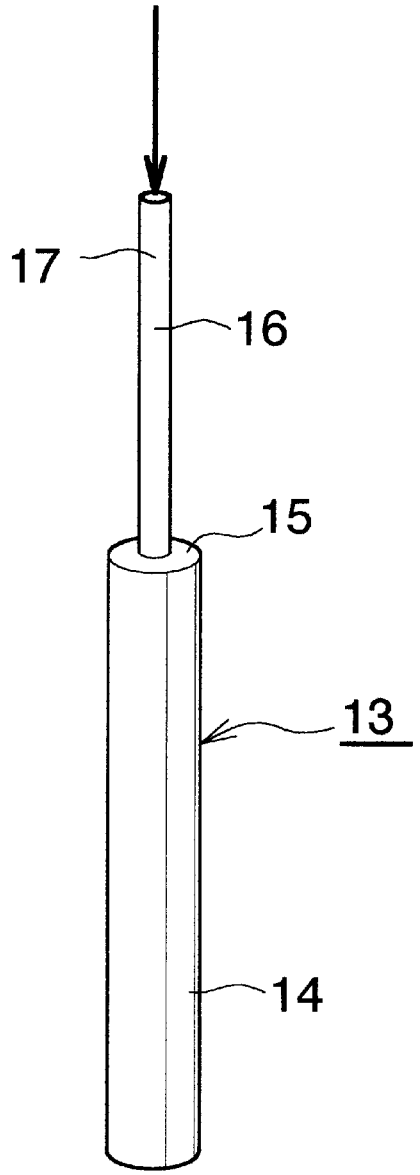
FIG. 8 is a perspective view showing a third embodiment of first feature of the invention in the step of injecting a working liquid into a container.

FIG. 8 shows a third embodiment of first feature of the present invention. The third embodiment is an application of the invention to the fabrication of a heat pipe in the form of a closed tube and adapted for use in heat exchangers, and has the same construction as the first except the following. As shown in FIG. 8, this embodiment has a container 13 which comprises a metal tube 14 having a large diameter and end caps 15 joined to respective opposite ends of the tube 14. A metal tube 16 of small diameter is joined at one end thereof to one of the end caps 15 around a hole (not shown) formed in the center of the cap to provide on the container 13 an outwardly projecting tube portion 17 for providing the gas retaining portion.

FIGS. 9 to 12 show a first embodiment of second feature of the present invention. This embodiment is an application of the invention to the fabrication of a flat platelike heat pipe for use as a heat sink, for example, in personal computers or like electronic devices.

Figure 9:
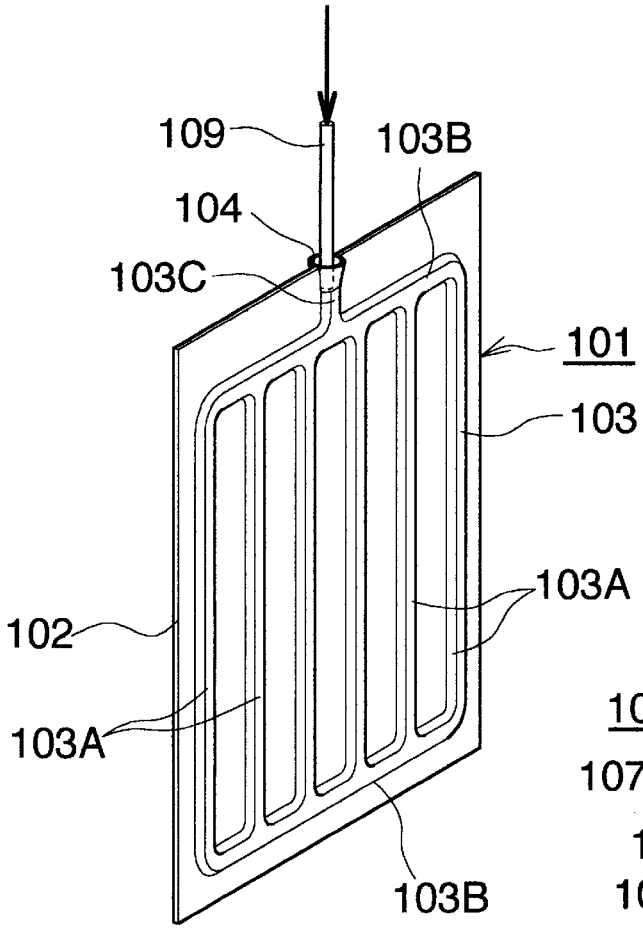
FIGS. 9 to 12 show a first embodiment of second feature of the invention.

First, a container 101 shown in FIG. 9 is prepared. This container 101 is made from a clad metal plate 102 having a tubular bulged portion 103 for enclosing a working liquid. The clad plate 102 comprises, for example, two aluminum alloy sheets. The tubular bulged portion 103 is produced by forming a nonbonded portion of predetermined pattern in the clad plate 102 and bulging the nonbonded portion toward one side or opposite sides. The tubular bulged portion 103 comprises a plurality of parallel straight parts 103A extending vertically, two communication parts 103B extending horizontally so as to cause all the straight parts 103A to communicate with one another respectively at upper and lower ends of the clad plate, and an injection part 103C extending upward from the lengthwise midportion of the upper communication part 103B. However, the pattern of the bulged portion 103 is not limited to the one shown in FIG. 9 but can be modified suitably. The injection part 103C has an upper end which has an opening at the upper edge of the clad plate 102, and this opening serves as a working liquid inlet 104. The liquid inlet 104 is flared so as to permit an opening portion 106 of the gas retaining receptacle 105 to be described later to fit in readily.

The container 101 is fabricated preferably by the so-called roll bonding process, i.e., by printing a parting agent in a predetermined pattern on at least one of the opposed surfaces of two metal sheets to be joined, then bonding the metal sheets under pressure to obtain a clad metal plate 102 having a nonbonded portion and introducing a pressure fluid into the nonbonded portion of the clad plate 102 to form a tubular bulged portion 103 in its entirety at a time, because this process has the advantages of forming the tubular bulged portion 103 of complex pattern, giving a leakage-free product, being highly amenable to mass production and having greater freedom with respect to the size and configuration of the product.

Figure 10:
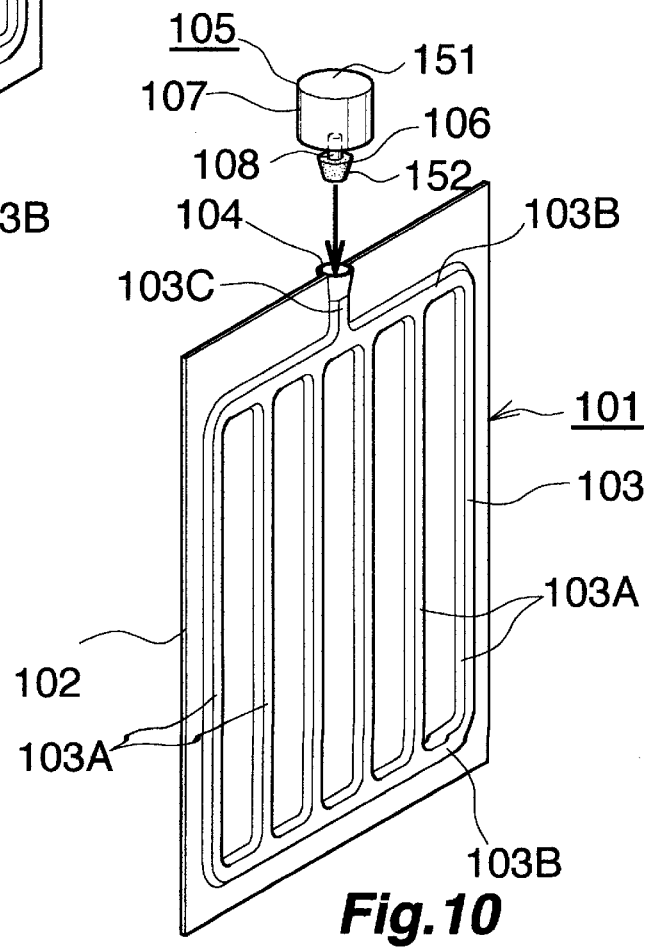

As shown in FIG. 10, on the other hand, the above-mentioned gas retaining receptacle 105 is prepared, which has the opening portion 106 to be snugly fitted into the liquid inlet 104 of the container 101. The gas retaining receptacle 105 comprises a receptacle body 151 made of synthetic resin and comprising a closed cylindrical trunk 107 and a tubular neck 108 extending from a lower wall of the trunk 107 and communicating with the interior of the trunk 107 through a hole formed in the lower wall; and an opening portion component 152 in the form of a tapered tube of rubber or like elastic material and fitted around the lower end of the neck 108 of the body 151. The construction and materials of the receptacle 105 are not limited to those described above; for example, the body 151 and the opening portion component 152 may be entirely made from rubber or like elastic material as an integral receptacle.

With reference to FIG. 9, a working liquid is injected into the tubular bulged portion 103 of the container 101 through an injection nozzle 109 inserted into the liquid inlet 104. Examples of useful working liquids are PFC, HFC134a, CFC113, HCFC123, etc.

Next as seen in FIG. 10, the opening portion 106 of the retaining receptacle 105 is snugly fitted into the liquid inlet 104 of the container 101.

Figure 11:
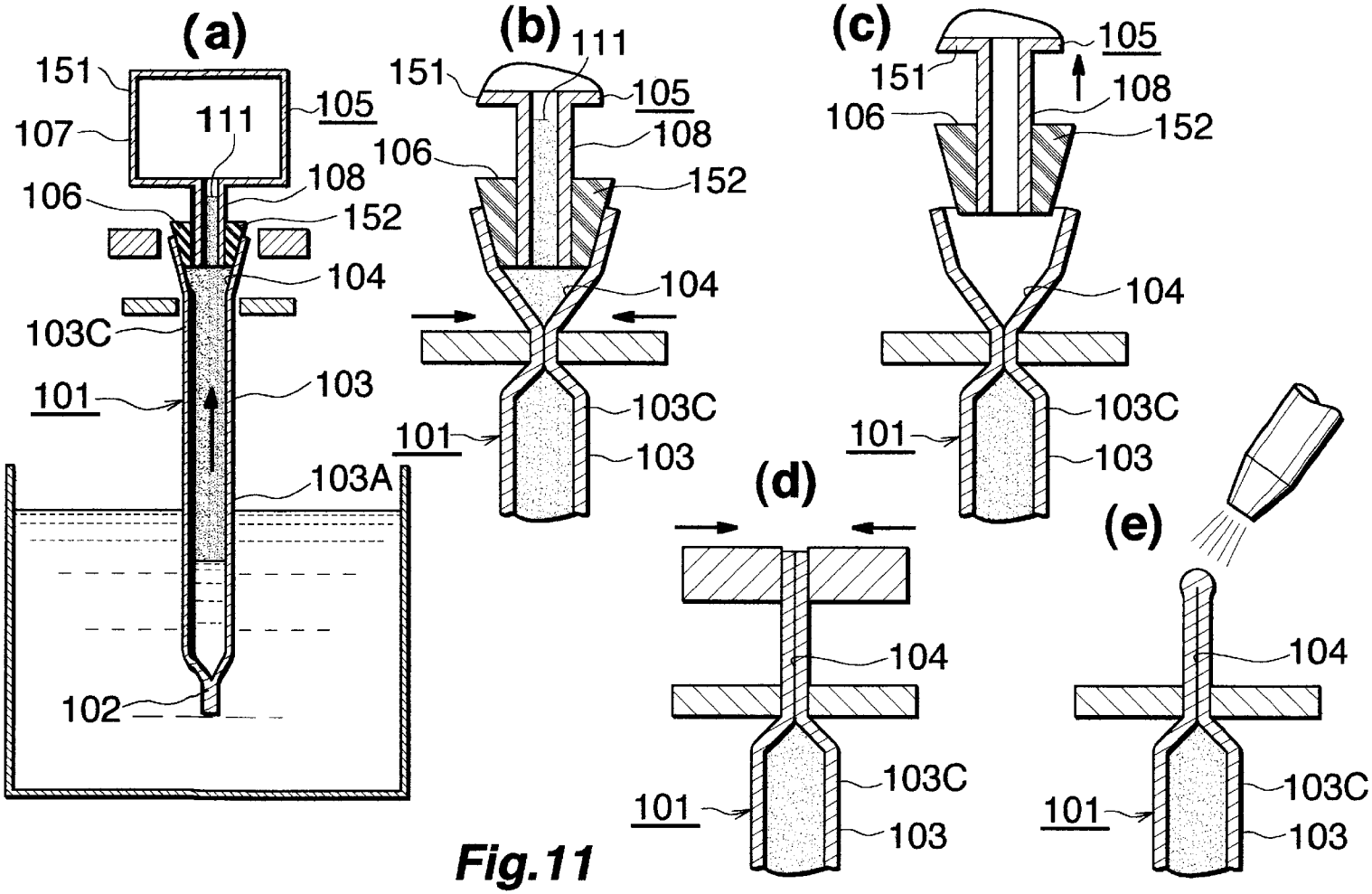

Subsequently, the container 101 is heated with the receptacle 105 up by immersing the lower portion thereof in hot water at 60° C. for a specified period of time as shown in FIG. 11(*a*). This evaporates the working liquid within the container 101 into a gas. The noncondensable gases, such as $N_2$, $O_2$ and $CO_2$, dissolved in the working liquid and those remaining in the tubular bulged portion 103 of the container 101 are driven into the gas retaining receptacle 105 and caused to remain therein by the evaporated gaseous working liquid [see FIG. 11(*a*)].

As shown in FIG. 11(*b*), the lower part of the portion of liquid inlet 104 of the container 101 is then collapsed to close the inlet 104.

The opening portion 106 of the receptacle 105 is thereafter removed from the liquid inlet 104 of the container 101 as seen in FIG. 11(*c*).

Further the portion of liquid inlet 104 of the container 101 is collapsed at its upper part as seen in FIG. 11(*d*), and the upper end of the collapsed portion of liquid inlet 104 is thereafter welded as shown in FIG. 11(*e*).

Figure 12:
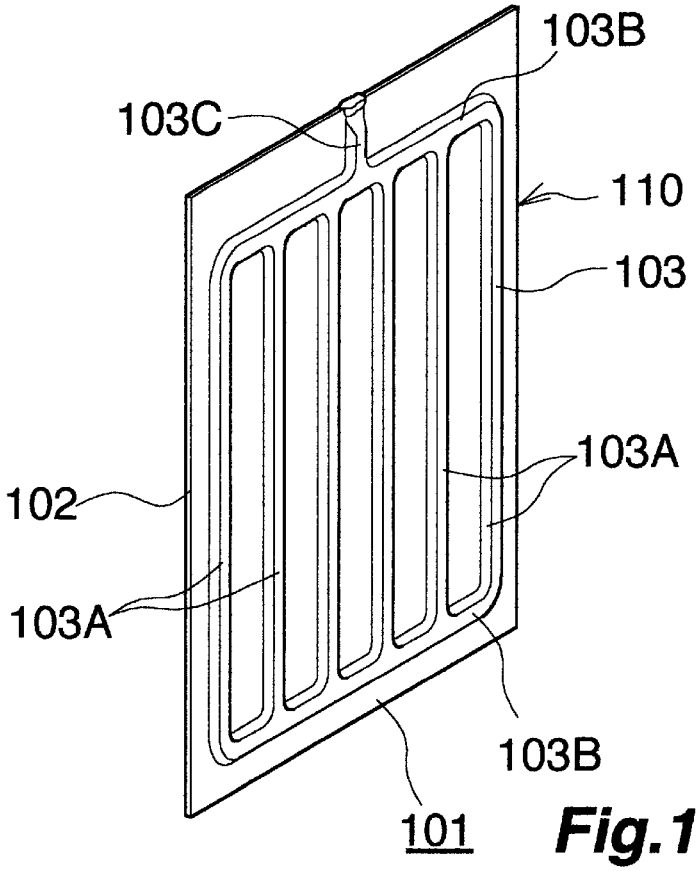

In this way, a flat platelike heat pipe 110 is obtained which contains the working liquid enclosed in the tubular bulged portion 103 of the container 101 as shown in FIG. 12.

For example, the following method is usable for checking the heat pipe 110 obtained by the above process as to whether noncondensable gases remain therein.

In the course of production, a weighing instrument is used to measure the weight of the container 101 having the working liquid injected therein and the gas retaining receptacle 105 attached thereto, with the opening portion 106 snugly fitted in the liquid inlet 104. Also measured by the weighing instrument is the combined weight of the heat pipe 110 obtained and the gas retaining receptacle 105 having its opening portion 106 removed from the container liquid inlet 104. The weight of the container 101 having the receptacle 105 and the combined weight of the resulting heat pipe 110 and the receptacle 105 separated off are then compared. The result of comparison indicates that the noncondensable gases remain in the heat pipe 110 obtained when substantially no difference is found between the two weights. On the other hand, the result of comparison indicates that no noncondensable gases remain in the heat pipe 110 obtained when the latter weight is smaller than the former.

The principle of this method of checking will be described in detail. When the working liquid is evaporated by heating the container 101 having the gas retaining receptacle 105 attached thereto, the noncondensable gases within the container 101 are caused to be retained in the receptacle 105. In the case where a boundary 111 between the portion of noncondensable gases and the gaseous working liquid is positioned within the gas retaining receptacle 105 in this state [see FIG. 11(*a*)], no noncondensable gases are to remain in the heat pipe 110 obtained. In the vicinity of the boundary 111 in this case, the gaseous working liquid adheres to the inner surface of the receptacle 105 upon condensation, and the adhering condensate thereafter dissipates into the atmosphere from the opening portion 106 of the receptacle 105 separated off, with the result that the combined weight of the heat pipe 110 obtained and the separated receptacle 105 becomes smaller than the weight of the container 101 having the receptacle 105 attached thereto. On the other hand, in the case where the boundary 111 between the portion of noncondensable gases and the gaseous working liquid is positioned within the tubular bulged portion 103 of the container 101, the noncondensable gases are to remain in the heat pipe 110 obtained. The gaseous working liquid undergoing condensation in the vicinity of the boundary 111 remains within the container 111 in this case, so that no difference occurs between the weight of the container 101 having the receptacle 105 attached thereto and the combined weight of the heat pipe 110 obtained and the separated receptacle 105.

The checking method described therefore makes it possible to readily check whether the noncondensable gases remain in the heat pipe 110 obtained by the very simple procedure of measuring and comparing the weights.

It is thought that the boundary between the portion of noncondensable gases and the gaseous working liquid shifts, for example, with the capacity of the gas retaining receptacle 105. Since the quantity of noncondensable gases dissolved in the working liquid increases in proportion to the amount of working liquid, it appears that the boundary shifts also with the amount of working liquid injected into the container 101. Accordingly the production condition not permitting the noncondensable gases to remain in the heat pipe can be found easily by fabricating heat pipes by the above process on an experimental basis, for example, with the capacity of the gas retaining receptacle 105 or the amount of working liquid to be injected varied suitably so as to increase stepwise while holding the other production conditions constant, and by checking the heat pipes as to whether the noncondensable gases remain therein. If heat pipes 110 are fabricated under the same production condition as is thus found, the pipes obtained undoubtedly contain no noncondensable gases remaining therein.

According to the present embodiment, the working liquid is injected into the tubular bulged portion 103 while allowing the noncondensable gases within this portion 103 to remain therein, and the opening portion 106 of the gas retaining receptacle 105 is thereafter snugly fitted into the liquid inlet 104, whereas the noncondensable gases remaining in the bulged portion 103 may be removed through the liquid inlet 104 before the liquid injection using, for example, a vacuum pump.

Figure 13:
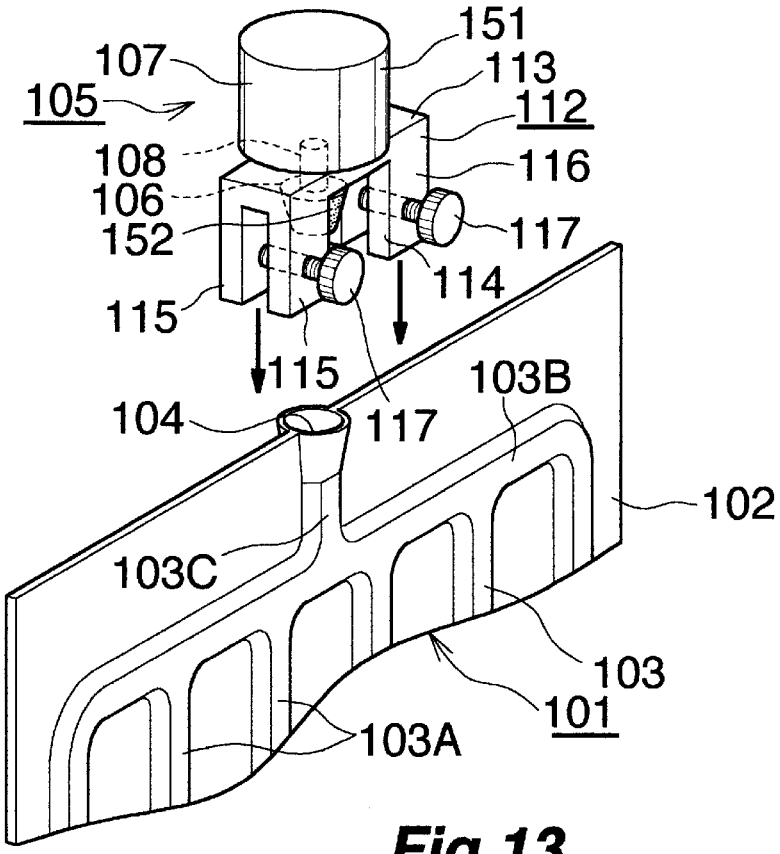
FIGS. 13 and 14 show a second embodiment of second feature of the invention.
Figure 14:
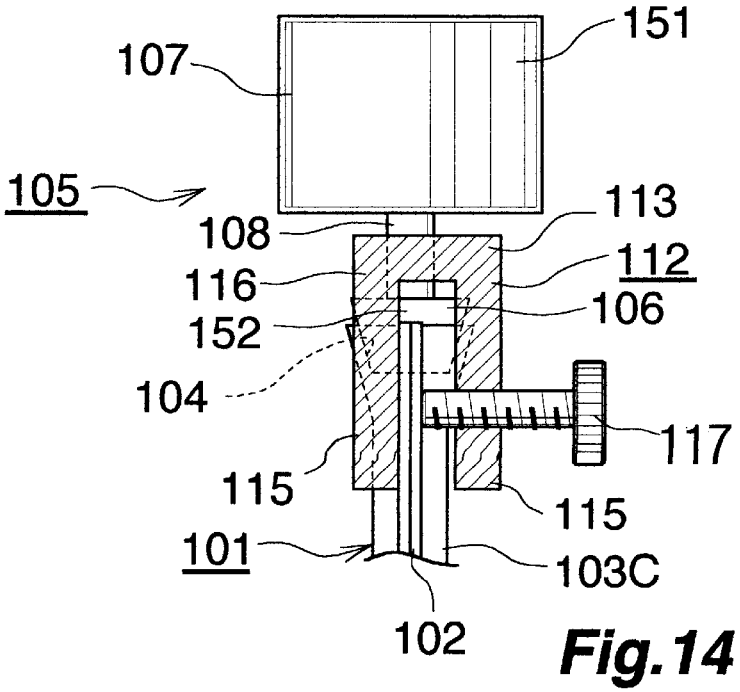

FIGS. 13 and 14 show a second embodiment of second feature of the invention. This second embodiment is the same as the first with the exception of the following. With reference to FIGS. 13 and 14, the gas retaining receptacle 105 is provided with a device 112 for fixing the receptacle to the container 101. The fixing device 112 comprises a holder 116 and locking screws 117. The older 116 comprises a horizontal wall 113 provided around and attached to the neck 108 of the receptacle body 151, and depending walls 115 extending downward respectively from the front and rear edges of the wall 112 so as to be positioned along opposite surfaces of the container 101 and each having in the middle of its length a rectangular cutout 114 formed in its lower edge so as to clear the liquid inlet portion 104. The screws 117 are screwed through the left and right side portions of front depending wall 115 of the holder 116 from the front. When the opening portion 106 of the gas retaining receptacle 105 is snugly fitted into the liquid inlet 104 of the container 101 having the working liquid placed therein, the holder 116 is fitted around the container inlet portion 104 together with the receptacle, and the locking screws 117 are screwed into pressing contact with the front side of the container 101. The device 112 thus installed obviates the likelihood that the receptacle opening portion 106 will slip out of the liquid inlet 104 even if the internal pressure of the tubular bulged portion 103 and the receptacle 105 builds up to excess when the container 101 is heated. The screws 117 of the fixing device 112 are loosened when the receptacle opening portion 106 is to be removed from the container liquid inlet 104.

Figure 15:
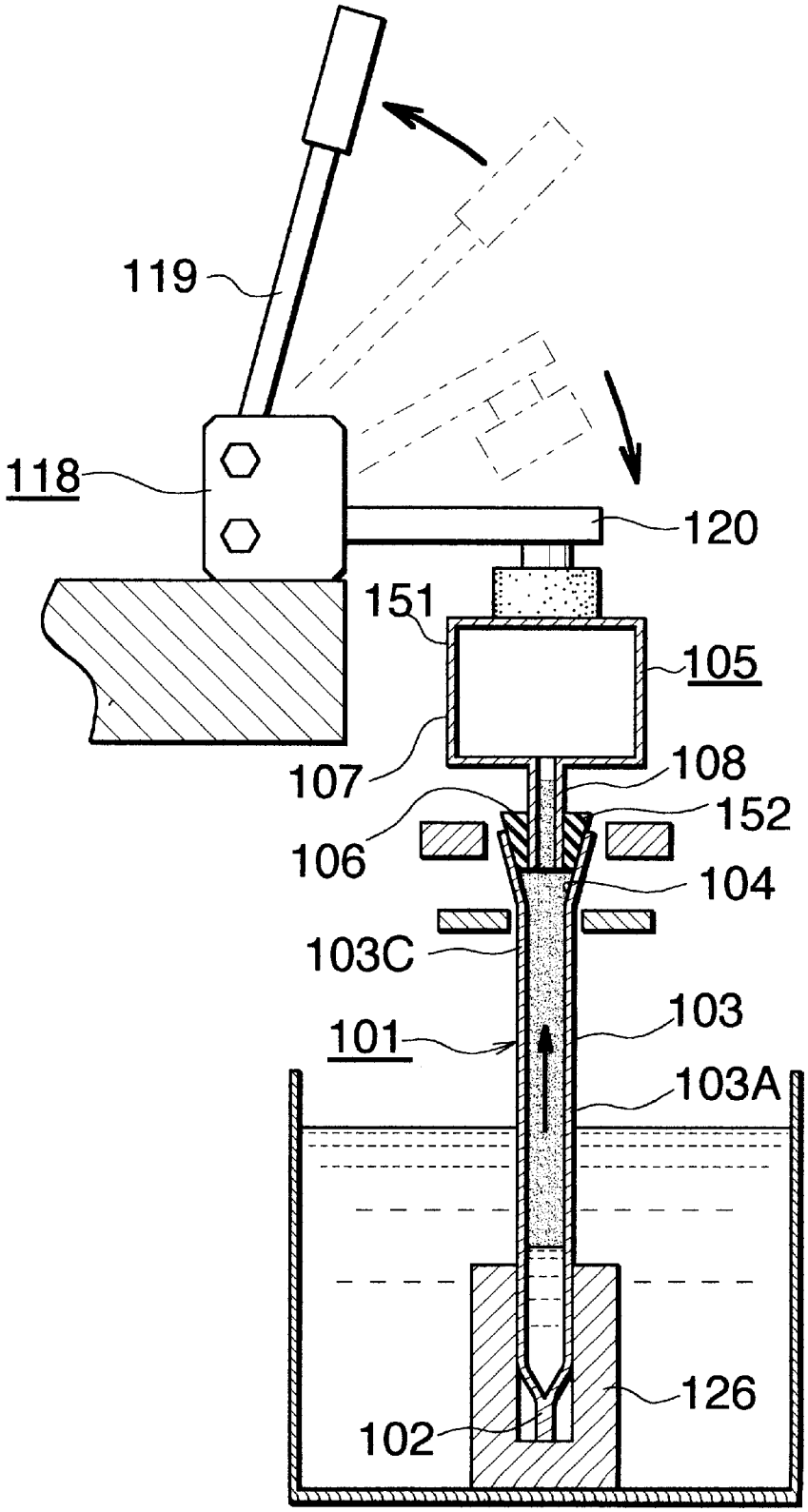
FIG. 15 is an enlarged fragmentary view in vertical section showing a third embodiment of second feature of the invention in the step of pressing a gas retaining receptacle against a container by a toggle clamp while heating the container.

FIG. 15 shows a third embodiment of second feature of the invention. This third embodiment has the same construction as the first with the exception of the following. With this embodiment, the bottom of body 151 of the gas retaining receptacle 105, having its opening portion 106 fitted in the liquid inlet 104, is pressed down by a toggle clamp 118 from above when the container 101 is heated as seen in FIG. 15. The toggle clamp 118 has a lever 119 which, when raised upward, moves a pressure member 120 downward into pressing contact with the bottom of receptacle body 151. The container 101 is held upright by a holder 126 U-shaped in cross section and disposed in the bottom of a water bath so as to be entirely immersed in hot water of the bath. As in the second embodiment, the use of this toggle clamp 118 obviates the likelihood that the receptacle opening portion 106 will slip out of the liquid inlet 104 even if the internal pressure of the tubular bulged portion 103 and the receptacle 105 builds up to excess when the container 101 is heated. The lever 119 of the toggle clamp 118 is pushed down to raise the pressure member 120 when the receptacle opening portion 106 is to be removed from the container liquid inlet 104.

Figure 16:
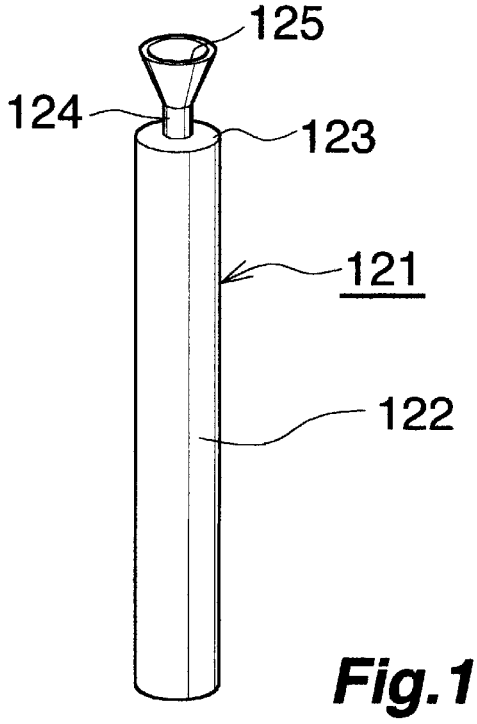
FIG. 16 is a perspective view showing a fourth embodiment of second feature of the invention in the step of injecting a working liquid into a container.

FIG. 16 shows a fourth embodiment of second feature of the present invention. The fourth embodiment is an application of the invention to the fabrication of a heat pipe in the form of a closed tube for use in heat exchangers. This embodiment has the same construction as the first with the exception of the following. This embodiment comprises a container 121 which, as shown in FIG. 16, comprises a metal tube 122 of large diameter, end caps 123 joined to respective opposite ends of the metal tube 122, and a metal tube 124 having a small diameter, one end joined to one of the end caps 123 around a hole (not shown) formed in the center thereof and the other end which is flared. The flared end of the thin tube 124 has an opening serving as a working liquid inlet 125.

FIGS. 17 to 20 show a first embodiment of third feature of the present invention. This first embodiment is an application of the invention to the fabrication of a flat platelike heat pipe for use as a heat sink, for example, in personal computers or like electronic devices.

Figure 17:
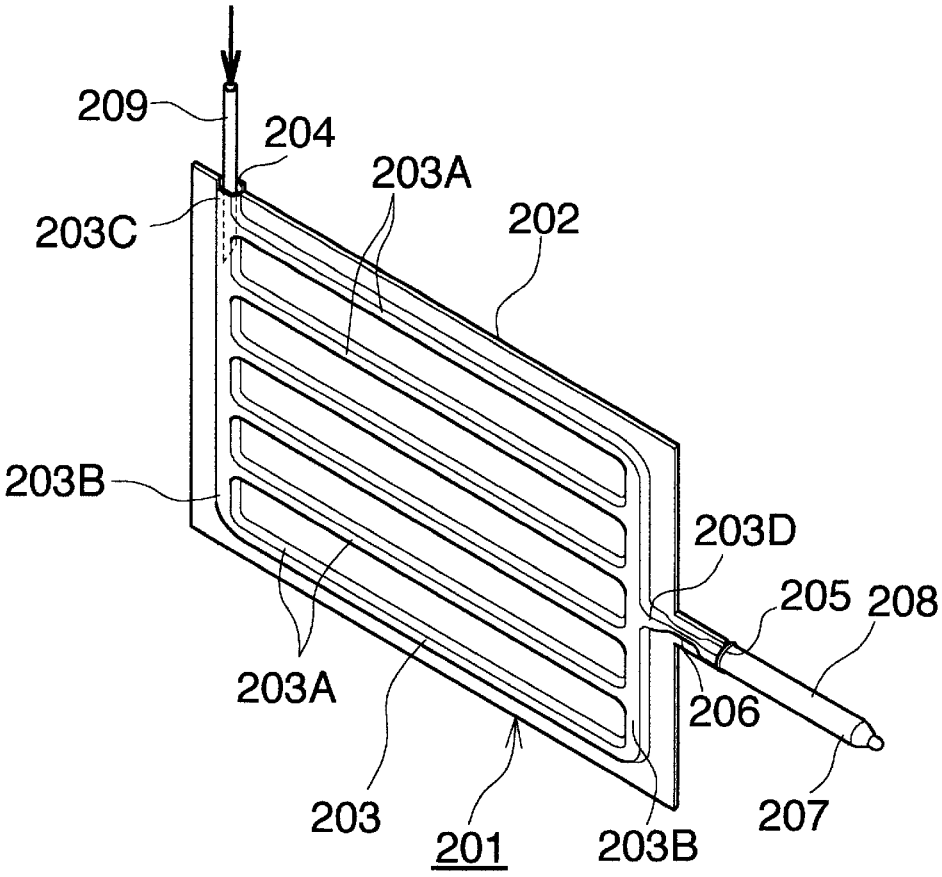
FIGS. 17 to 20 show a first embodiment of third feature of the invention.

First, a container 201 shown in FIG. 17 is prepared. This container 201 is made from a clad metal plate 202 having a tubular bulged portion 203 for enclosing a working liquid. The clad plate 202 comprises, for example, two aluminum alloy sheets. The tubular bulged portion 203 is produced by forming a nonbonded portion of predetermined pattern in the clad plate 202 and bulging the nonbonded portion toward one side or opposite sides. The tubular bulged portion 203 comprises a plurality of parallel straight parts 203A extending horizontally, two communication parts 203B extending vertically so as to cause all the straight parts 203A to communicate with one another respectively at the left and right ends of the clad plate, an injection part 203C extending upward from the upper end of the left communication part 203B, and an outlet part 203D extending rightward from the lengthwise midportion of the right communication part 203B. However, the pattern of the bulged portion 203 is not limited to the one shown in FIG. 17 but can be modified suitably. The injection part 203C has an upper end which has an opening at the upper edge of the clad plate 202, and this opening serves as an inlet 204 for a working liquid. The clad metal plate 202 is cut away at the upper and lower sides of the right half of the outlet part 203D, thereby making the right half of the outlet part 203D project rightward. The right end of the outlet part 203D has an opening at the right edge of the clad plate 202, and this opening serves as an outlet 205 for noncondensable gases. When the working liquid inlet 204 and the noncondensable gas outlet 205 are thus positioned, the working liquid will not flow into a gas retaining portion when injected into the tubular bulged portion 203 as will be described later, nor will the noncondensable gases remain in the vicinity of the inlet 204 inside the bulged portion 203 when the working liquid is evaporated by heating the container 201. A constriction 206 for preventing the working liquid from flowing out is provided in the tubular bulged portion 203 at a location close to the gas outlet 205, i.e., at a lengthwise intermediate portion of the outlet part 203D. The constriction 206 is internally so dimensioned as to permit the noncondensable gases to pass therethrough smoothly while making it difficult for the working liquid to pass therethrough when bumping. For example, the constriction 206 is about 0.8 mm in inside diameter when the inside channel of the outlet part 203D other than the constriction 206 is about 9 mm in vertical width and about 2.8 mm in front-to-rear width.

The container 201 is fabricated preferably by the so-called roll bonding process, i.e., by printing a parting agent in a predetermined pattern on at least one of the opposed surfaces of two metal sheets to be joined, then bonding the metal sheets under pressure to obtain a clad metal plate 202 having a nonbonded portion and introducing a pressure fluid into the nonbonded portion of the clad plate 202 to form a tubular bulged portion 203 in its entirety at a time, because this process has the advantages of forming the tubular bulged portion 203 of complex pattern, giving a leakage-free product, being highly amenable to mass production and having greater freedom with respect to the size and configuration of the product.

The container 201 is provided with an outwardly projecting hollow gas retaining portion 207 having an interior in communication with the interior of the tubular bulged portion 203 via the gas outlet 205. According to the present embodiment, the gas retaining portion 207 is provided by a metal tube 208 having one end closed by collapsing and welding and the other end welded to the peripheral edge of the gas outlet 205 of the container 201.

With reference to FIG. 17, a working liquid is injected into the tubular bulged portion 203 of the container 201 through an injection nozzle 209 inserted into the liquid inlet 204. Examples of useful working liquids are PFC, HFC134a, CFC113, HCFC123, etc.

Figure 18:
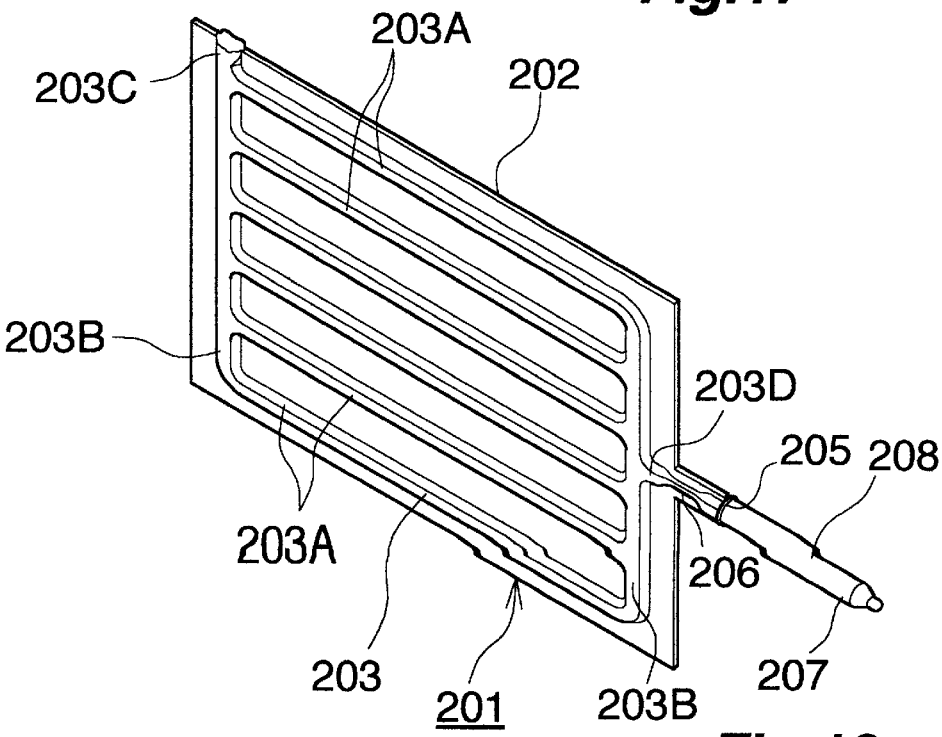

As seen in FIG. 18, the portion of liquid inlet 204 of the container 201 is thereafter collapsed to close the inlet 204, and the upper end of the collapsed portion of inlet 204 is subsequently welded.

Figure 19:
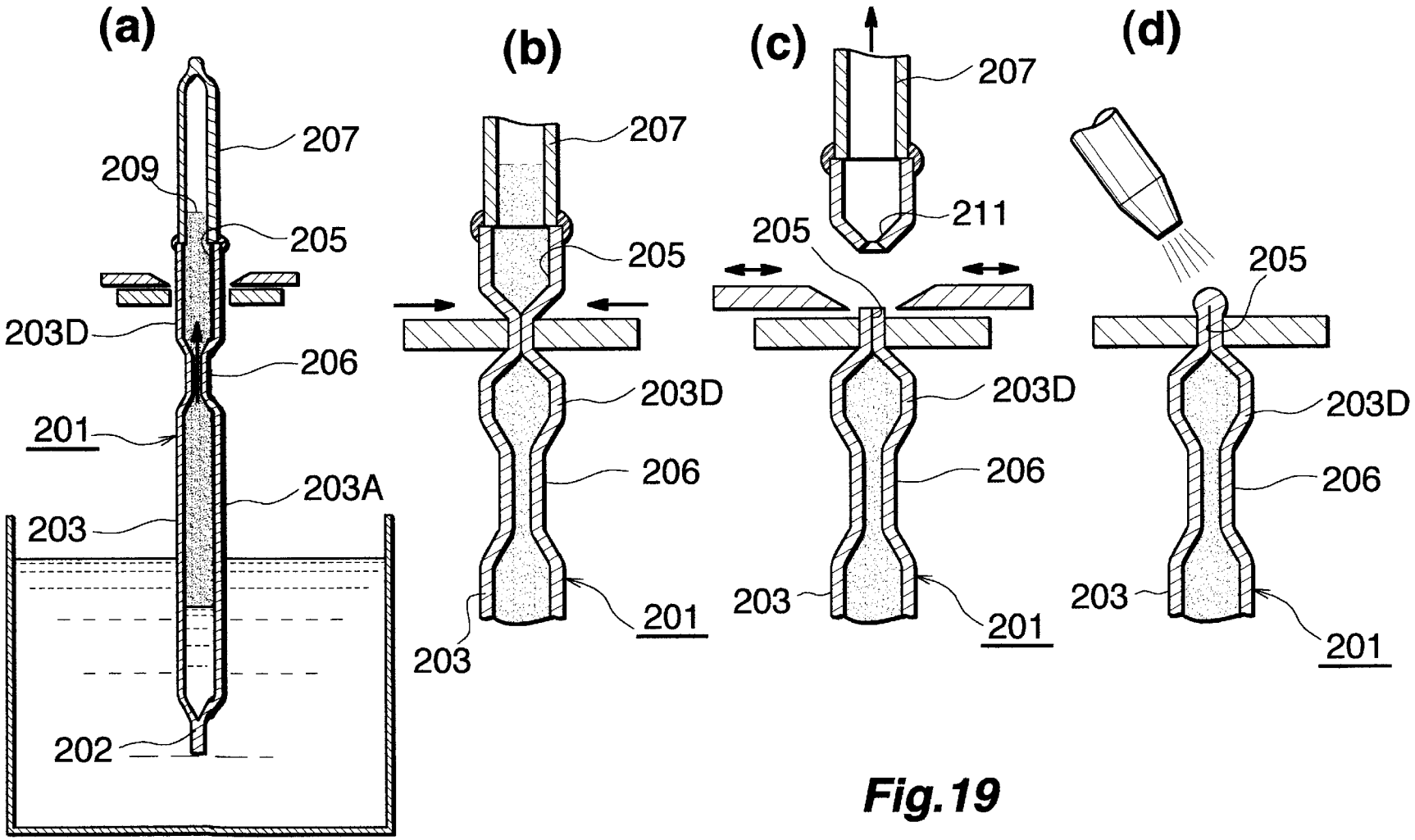

Next, the container 201 is heated with the gas retaining portion 207 up by immersing the lower portion thereof in hot water at 60° C. for a specified period of time as shown in FIG. 19(*a*). This evaporates the working liquid within the container 201 into a gas. The noncondensable gases, such as $N_2$, $O_2$ and $CO_2$, dissolved in the working liquid and those remaining in the tubular bulged portion 203 of the container 201 are driven into the gas retaining portion 207 and caused to remain therein by the evaporated gaseous working liquid [see FIG. 19(*a*)]. Although likely to bump at this time, the working liquid is almost completely prevented from flowing out in spite of bumping by the constriction 206 provided at a lengthwise intermediate portion of the outlet part 203D.

As shown in FIG. 19(*b*), the portion of gas outlet 205 of the container 201 is then collapsed to close the outlet 205.

The collapsed portion of outlet 205 of the container 201 is thereafter cut at its upper end to thereby separate the gas retaining portion 207 from the container 201 for removal as seen in FIG. 19(*c*).

Further the cut end of the collapsed portion of outlet 205 of the container 201 is welded as seen in FIG. 19(*d*).

Figure 20:
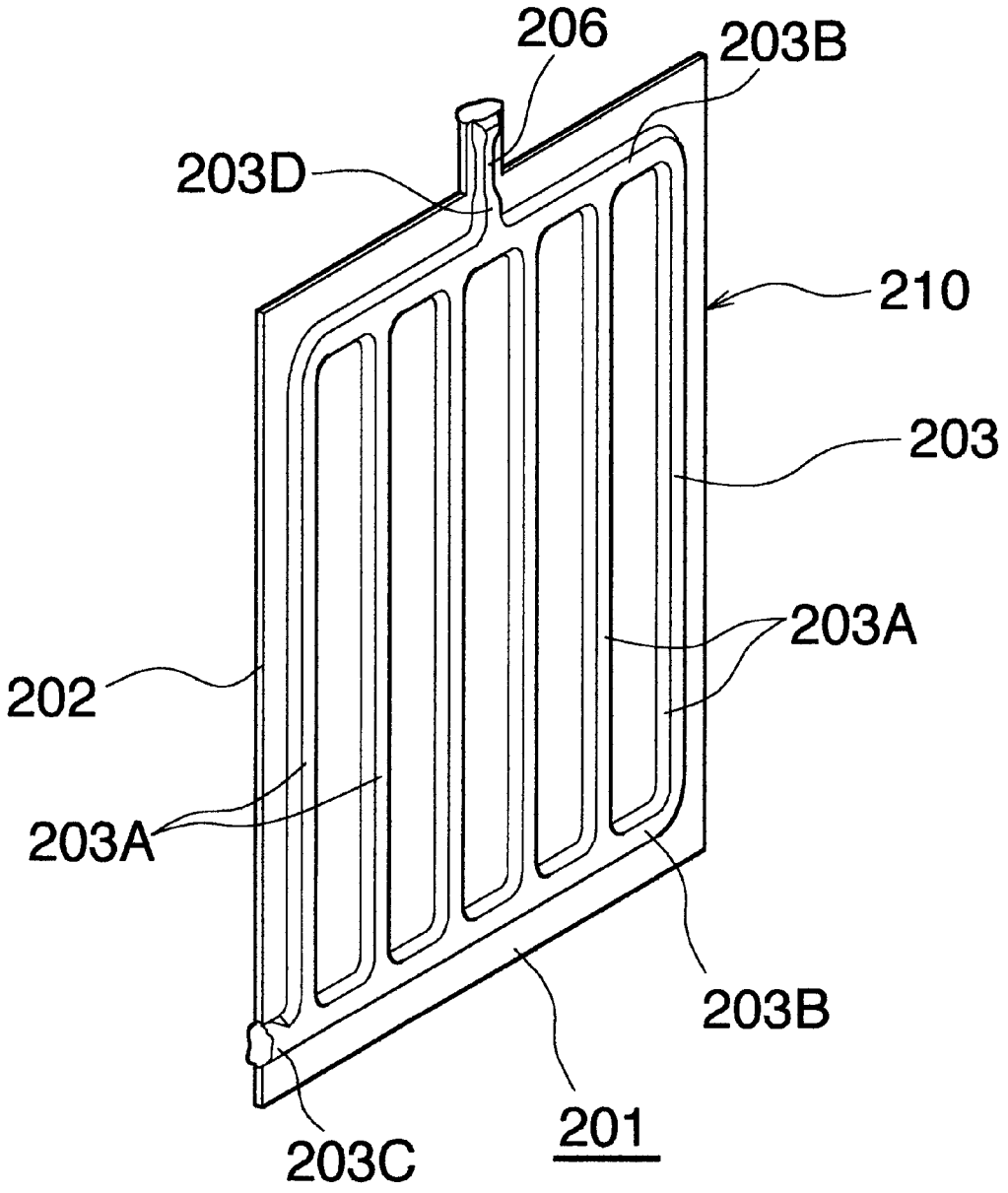

In this way, a flat platelike heat pipe 210 is obtained which contains the working liquid enclosed in the tubular bulged portion 203 of the container 201 as shown in FIG. 20.

For example, the following method is usable for checking the heat pipe 210 obtained by the above process as to whether noncondensable gases remain therein.

In the course of production, a weighing instrument is used to measure the weight of the container 201 having the working liquid injected therein and the gas retaining portion 207 attached thereto, with the inlet 204 closed. Also measured by the weighing instrument is the combined weight of the heat pipe 210 obtained and the gas retaining portion 207 separated from the container 201. The weight of the container 201 having the gas retaining portion 207 attached thereto and the combined weight of the resulting heat pipe 210 and the gas retaining portion 207 separated off are then compared. The result of comparison indicates that the noncondensable gases remain in the heat pipe 210 obtained when substantially no difference is found between the two weights. On the other hand, the result of comparison indicates that no noncondensable gases remain in the heat pipe 210 obtained when the latter weight is smaller than the former.

The principle of this method of checking will be described in detail. When the working liquid is evaporated by heating the container 201 having the gas retaining portion 207 attached thereto, the noncondensable gases within the container 201 are caused to be retained in the retaining portion 207. In the case where a boundary 209 between the portion of noncondensable gases and the gaseous working liquid is positioned within the gas retaining portion 207 in this state [see FIG. 19(*a*)], no noncondensable gases are to remain in the heat pipe 210 obtained. In the vicinity of the boundary 209 in this case, the gaseous working liquid adheres to the inner surface of the gas retaining portion 207 upon condensation, and the adhering condensate thereafter dissipates into the atmosphere from an opening 211 of the portion 207 separated off [see FIG. 19(*c*)], with the result that the combined weight of the heat pipe 210 obtained and the separated retaining portion 207 becomes smaller than the weight of the container 201 having the portion 207 attached thereto. On the other hand, in the case where the boundary 209 between the portion of noncondensable gases and the gaseous working liquid is positioned within the tubular bulged portion 203 of the container 201, the noncondensable gases are to remain in the heat pipe 210 obtained. The gaseous working liquid undergoing condensation in the vicinity of the boundary 209 remains within the container 201 in this case, so that no difference occurs between the weight of the container 201 having the gas retaining portion 207 and the combined weight of the heat pipe 210 obtained and the separated retaining portion 207.

The checking method described therefore makes it possible to readily check whether the noncondensable gases remain in the heat pipe 210 obtained by the very simple procedure of measuring and comparing the weights.

It is thought that the boundary 209 between the portion of noncondensable gases and the gaseous working liquid shifts, for example, with the capacity of the gas retaining portion 207. Since the quantity of noncondensable gases dissolved in the working liquid increases in proportion to the amount of working liquid, it appears that the boundary 209 shifts also with the amount of working liquid injected into the container 201.

Accordingly the production condition not permitting the noncondensable gases to remain in the heat pipe can be found easily by fabricating heat pipes 210 by the above process on an experimental basis, for example, with the capacity of the gas retaining portion 207 or the amount of working liquid to be injected varied suitably so as to increase stepwise while holding the other production conditions constant, and by checking the heat pipes as to whether the noncondensable gases remain therein. If heat pipes 210 are fabricated under the same production condition as is thus found, the pipes obtained will undoubtedly contain no noncondensable gases remaining therein.

According to the present embodiment, the working liquid is injected into the tubular bulged portion 203 while allowing the noncondensable gases within this portion 203 to remain therein, and the liquid inlet 204 is thereafter closed, whereas the noncondensable gases remaining in the bulged portion 203 may be removed through the liquid inlet 204 before the liquid injection using, for example, a vacuum pump.

Figure 21:
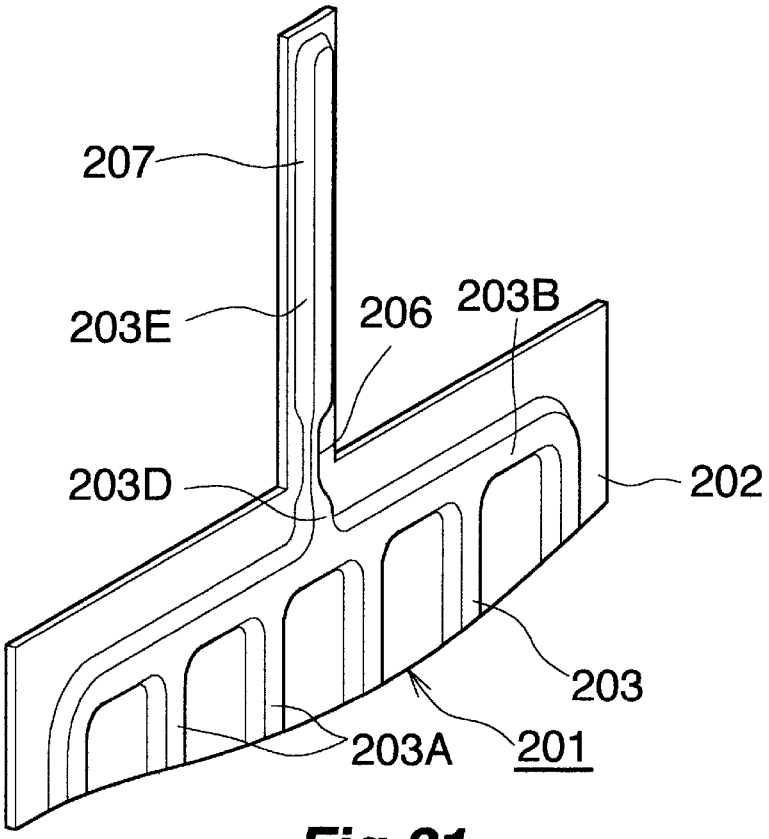
FIG. 21 is a perspective view showing a second embodiment of third feature of the invention, i.e., a gas retaining portion provided on a container, on an enlarged scale.

FIG. 21 shows a second embodiment of third feature of the invention. This second embodiment is the same as the first except the following. As shown in FIG. 21, this embodiment has a gas retaining portion 207 which is formed by part of the clad metal plate 201 providing the container 201. More specifically, the container 201 shown in FIG. 21 has a gas retaining tubular bulged part 203E integral with the outlet part 203D of tubular bulged portion 203 of the container. The tubular bulged part 203E provides the gas retaining portion 207. This eliminates the use of the metal tube 208, a separate part, which is necessary for the first embodiment, resulting a reduced cost and saving the time and labor required for welding the metal tube 208 to the container 201.

Figure 22:
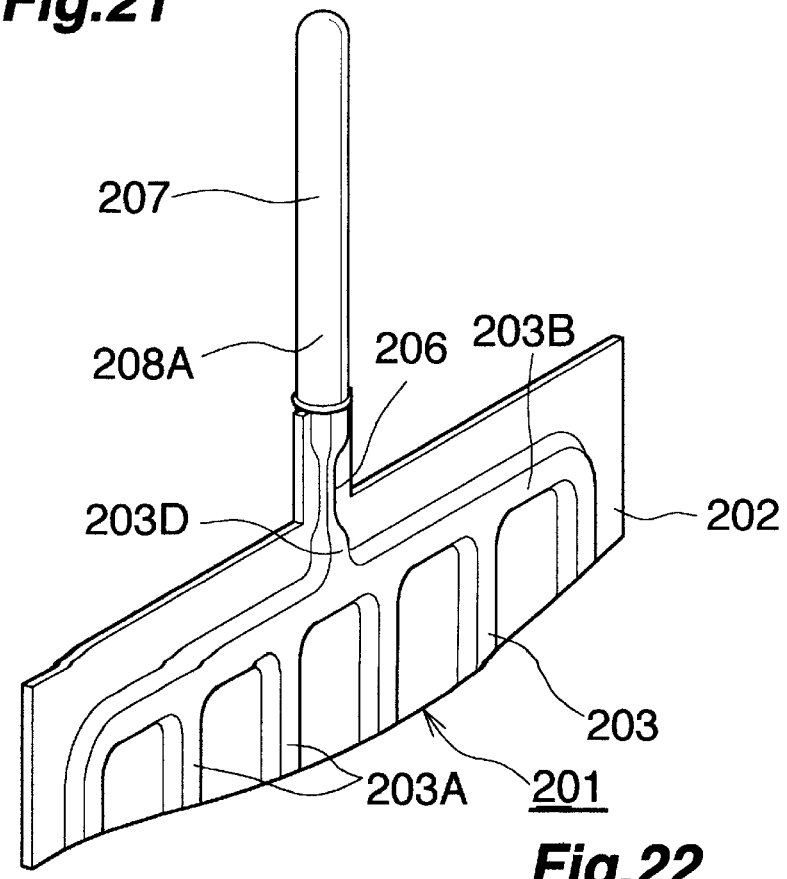
FIG. 22 is a perspective view showing a third embodiment of third feature of the invention, i.e., a gas retaining portion provided on a container, on an enlarged scale.

FIG. 22 shows a third embodiment of third feature of the invention, which is the same as the first embodiment except the following. This embodiment has a gas retaining portion 207 provided by a metal tube 208A, one end of which is made hemispherical by explosive working and thereby closed.

Figure 23:
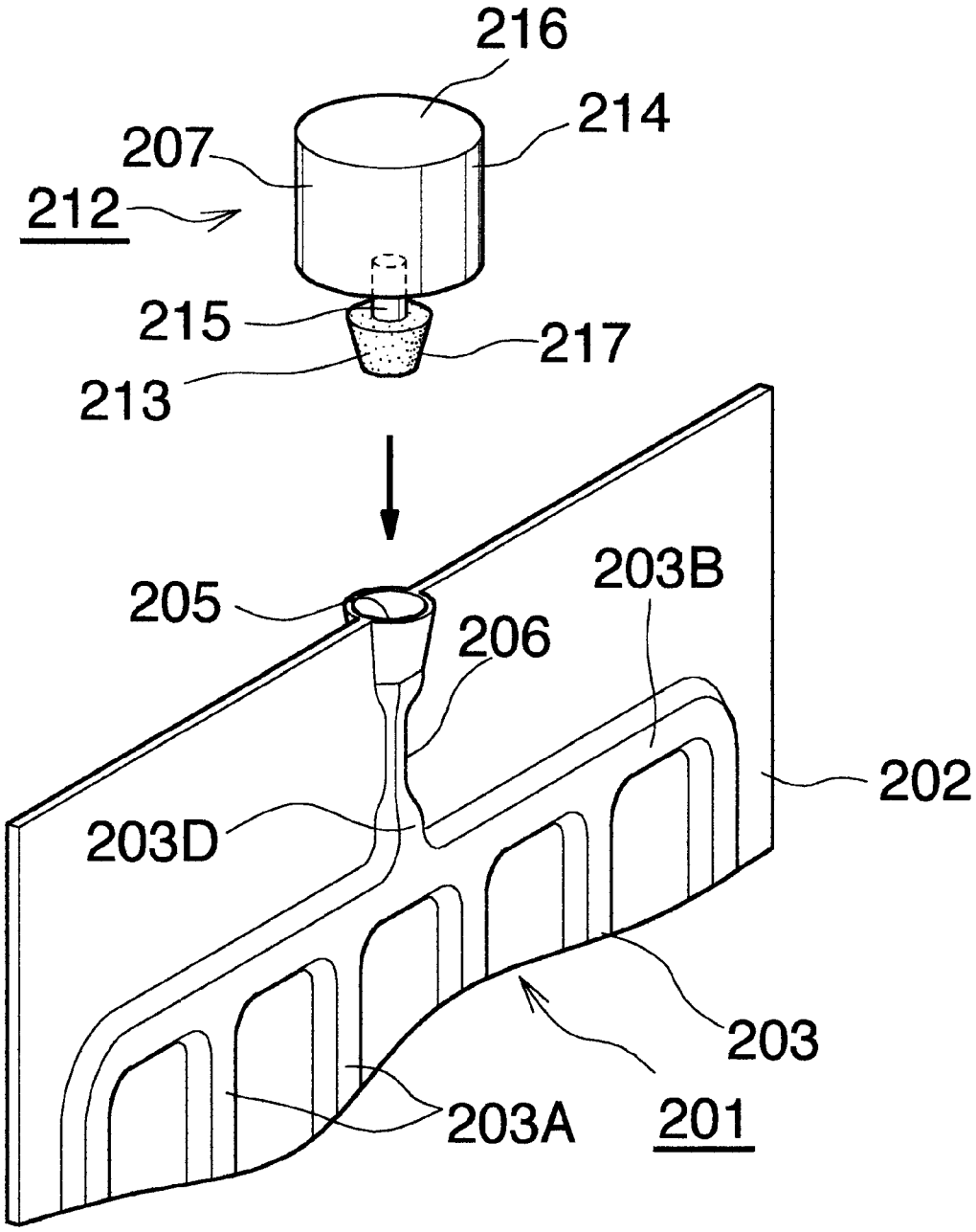
FIG. 23 is a perspective view showing a fourth embodiment of third feature of the invention, i.e., a gas retaining portion provided on a container, on an enlarged scale.

FIG. 23 shows a fourth embodiment of third feature of the invention. This fourth embodiment is the same as the first with the exception of the following. This embodiment has a gas retaining portion 207 which comprises a gas retaining receptacle 212. The outlet part 203D of tubular bulged portion 203 of the container 201 has a noncondensable gas outlet 205 which is flared and opened at the upper edge of the clad metal plate 202. The receptacle 212 has an opening portion 213 snugly fitted in the flared outlet 205. The gas retaining receptacle 212 comprises a receptacle body 216 of synthetic resin, and an opening portion component 217 in the form of a tapered tube. The receptacle body 216 comprises a closed cylindrical trunk 214 and a tubular neck 215 extending from a lower wall of the trunk 214 and communicating with the interior of the trunk 214 through a hole formed in the lower wall. The opening portion component 217 is made of rubber or like elastic material and fitted around the lower end of the neck 215 of the body 216. However, the construction and materials of the receptacle 212 are not limited to those described above; for example, the body 216 and the opening portion component 217 may be entirely made from rubber or like elastic material as an integral receptacle. With the opening portion 213 of the receptacle 212 snugly fitted in the gas outlet 205, a working liquid is placed in, the container 201 is heated, the portion of gas outlet 205 is then collapsed to close the outlet 205, and the receptacle opening portion 213 is removed from the outlet 205. Thus, the use of the gas retaining receptacle 212 obviates the need to cut off the metal tube 208 or 208A or the part of the clad plate 202 which provides the gas retaining portion 207 and which is included in the first to third embodiments, while the receptacle 212 is repeatedly usable, hence an improved yield.

What is claimed is:

1. In the production of a heat pipe formed by a container having an outwardly projecting tube portion whose interior defines a gas retaining portion in communication with the interior of the container and into which container a working liquid is injected through an outer end opening of said gas retaining portion prior to closing said opening, said container being heated when said outer end opening of said outwardly projecting tube portion is closed to evaporate the working liquid thereby causing the gas retaining portion to receive noncondensable gases from said container, and a container opening establishing said communication between the interior of said container and the interior of said gas retaining portion being closed, and the gas retaining portion being separated from the container to produce the heat pipe, the method of checking for the existence of noncondensable gases in the container comprising the steps of:

measuring the weight of the container prior to removal of the closed gas retaining portion;

measuring the weight of the produced heat pipe together with the separated gas retaining portion;

comparing the measured weights obtained from conduct of the foregoing steps;

determining that the produced heat pipe contains noncondensable gases when no difference in weight measurements is found to exist; and determining that the produced heat pipe contains no noncondensable gases when the weight obtained from the second weight measuring step is smaller than that from the first weight measuring step.

2. A method according to claim 1 wherein the container comprises a clad metal plate having a tubular bulged portion for enclosing the working liquid in the container, and the tubular bulged portion has an open end at an edge of the plate.

3. A method according to claim 2 wherein the outwardly projecting tube portion comprises a tube having one end joined to a peripheral edge of the bulged portion open end.

4. A method according to claim 2 wherein the outwardly projecting tube portion comprises a tubular bulged portion outwardly projecting from the clad metal plate for providing the gas retaining portion so as to be integral with the tubular bulged portion for enclosing the working liquid.

5. A method according to claim 1 wherein the container comprises a tube having a large diameter and being closed at opposite ends with respective end caps, and the outwardly projecting tube portion comprises a tube having a small diameter and being joined at one end thereof to an inner periphery of a hole formed in one of the end caps.

6. A process for producing a heat pipe by forming on a container an outwardly projecting tube portion having an interior in communication with an interior of the container for providing a gas retaining portion, injecting a working liquid into the container through an outer end opening of the tube portion, subsequently closing the end opening of the tube portion to thereby form the gas retaining portion on the container, heating the container to evaporate the working liquid and thereby cause the gas retaining portion to retain therein noncondensable gases from within the container, thereafter closing a container opening in communication with gas retaining portion and separating the gas retaining portion from the container for removal, the process being practiced under a production condition including a noncondensable gas checking method according to claim 1 and not permitting the noncondensable gases to remain in the heat pipe.

7. A process according to claim 6 wherein a plurality of heat pipes each having a gas retaining portion and produced on an experimental basis are checked by a non-condensable gas checking method according to claim 1 as to whether noncondensable gases remain therein to thereby determine the production condition for not permitting the noncondensable gases to remain in the heat pipe, the plurality of heat pipes being produced under a condition that they differ only in the capacity of the gas retaining portion.

8. A process according to claim 6 wherein a plurality of heat pipes each having a gas retaining portion and produced on an experimental basis are checked by a method according to claim 1 as to whether noncondensable gases remain therein to thereby determine the production condition for not permitting the noncondensable gases to remain in the heat pipe, the plurality of heat pipes being produced under a condition that they differ only in the amount of working liquid injected into the container.

9. A process for producing a heat pipe comprising preparing a container having a working liquid inlet and a gas retaining receptacle having an opening portion snugly fittable in the liquid inlet, snugly fitting the receptacle opening portion into the liquid inlet after injecting a working liquid into the container through the inlet, heating the container to evaporate the working liquid and thereby cause the receptacle to retain therein noncondensable gases within the container, thereafter closing the liquid inlet and removing the receptacle opening portion from the liquid inlet.

10. A process according to claim 9 wherein the container comprises a clad metal plate having a tubular bulged portion for enclosing the working liquid in the container, and the tubular bulged portion has an open end at an edge of the plate.

11. A process according to claim 9 wherein the container comprises a tube having a large diameter and closed at opposite ends with respective end caps and a tube having a small diameter and joined at one end thereof to an inner periphery defining a hole formed in one of the end caps.

12. A process according to any one of claims 9 to 11 wherein when the container is heated, the receptacle is fixed to the container to prevent the receptacle opening portion from slipping out of the liquid inlet.

13. A process according to any one of claims 9 to 11 wherein when the container is heated, the receptacle is pressed against the container to prevent the receptacle opening portion from slipping out of the liquid inlet.

14. A process for producing a flat platelike heat pipe comprising:

preparing a container made from a clad metal plate having a tubular bulged portion, the tubular bulged portion being provided with a working liquid inlet and a noncondensable gas outlet each opened at an edge of the plate and, the tubular bulged portion being provided with a constriction in the vicinity of the gas outlet, the container being provided with a gas retaining portion in the form of an outward projection and having an interior in communication with the interior of the tubular bulged portion through the gas outlet, closing the liquid inlet after injecting a working liquid into the tubular bulged portion of the container, heating the container to evaporate the working liquid and thereby cause the gas retaining portion to retain therein noncondensable gases within the tubular bulged portion while preventing the working liquid from flowing out owing to bumping by the constriction, and thereafter closing the gas outlet and separating the gas retaining portion from the container for removal.

15. A process according to claim 14 wherein the liquid inlet and the gas outlet are so positioned that the working liquid does not flow into the gas retaining portion when injected into the tubular bulged portion and that the noncondensable gases do not remain in the vicinity of the liquid inlet inside the bulged portion hen evaporated by heating the container.

16. A process according to claim 14 or 15 wherein the gas retaining portion comprises a tube closed at one end and joined at the other end to a peripheral edge part of the gas outlet of the tubular bulged portion.

17. A process according to claim 16 wherein said one end of the tube is made hemispherical and closed.

18. A process according to claim 14 or 15 wherein the gas retaining portion comprises a tubular bulged portion outwardly projecting from the clad metal plate so as to be integral with the tubular bulged portion for enclosing the working liquid.

19. A process according to claim 14 or 15 wherein the gas retaining portion comprises a gas retaining receptacle having an opening portion snugly fitted in the gas outlet.

* * * * *